US007914425B2

(12) United States Patent
Hanoun

(10) Patent No.: US 7,914,425 B2
(45) Date of Patent: Mar. 29, 2011

(54) HYDRAULIC EXERCISE MACHINE SYSTEM AND METHODS THEREOF

(75) Inventor: Reed Hanoun, Mississauga (CA)

(73) Assignee: MYTRAK Health System Inc., Ontario (CA)

( * ) Notice: Subject to any disclaimer, the term of this patent is extended or adjusted under 35 U.S.C. 154(b) by 407 days.

(21) Appl. No.: 11/737,988

(22) Filed: Apr. 20, 2007

(65) Prior Publication Data

US 2007/0232451 A1 Oct. 4, 2007

Related U.S. Application Data

(63) Continuation-in-part of application No. PCT/CA2005/001620, filed on Oct. 24, 2005, and a continuation-in-part of application No. PCT/CA2005/001626, filed on Oct. 24, 2005.

(60) Provisional application No. 60/620,679, filed on Oct. 22, 2004, provisional application No. 60/680,474, filed on May 13, 2005.

(51) Int. Cl.
*A63B 21/008* (2006.01)

(52) U.S. Cl. ..... 482/113; 482/8; 482/111; 482/112

(58) Field of Classification Search ..... 482/1–9, 482/91, 92, 900–902, 111–113, 84; 601/23, 601/34; 434/247
See application file for complete search history.

(56) References Cited

U.S. PATENT DOCUMENTS 2,767,920 A 10/1956 Roberson
4,050,171 A 9/1977 Teach
4,621,620 A * 11/1986 Anderson ..... 601/34
4,828,257 A 5/1989 Dyer
4,934,694 A 6/1990 McIntosh
5,149,084 A 9/1992 Dalebout et al.
5,154,677 A 10/1992 Ito
5,179,792 A 1/1993 Brantingham
5,277,197 A 1/1994 Church et al.
5,290,205 A 3/1994 Densmore et al.
5,308,300 A 5/1994 Chino et al.
5,335,188 A 8/1994 Brisson
5,361,775 A 11/1994 Remes et al.
5,387,164 A 2/1995 Brown, Jr.
5,435,315 A 7/1995 McPhee et al.
5,437,289 A 8/1995 Liverance et al.

(Continued)

FOREIGN PATENT DOCUMENTS

EP 0569879 11/1993

(Continued)

OTHER PUBLICATIONS

Long, Robert F. , Final Office Action for U.S. Appl. No. 11/737,970 Dec. 26, 2008.

(Continued)

*Primary Examiner* — Glenn Richman

(74) *Attorney, Agent, or Firm* — Damon Morey LLP; David L. Principe

(57) ABSTRACT

A hydraulic exercise machine system comprises one or more hydraulic cylinders, a mechanism coupled to at least one of the hydraulic cylinders, and a sensor assembly. Displacement of the mechanism by a person exercising on the hydraulic exercise machine displaces pistons of the hydraulic cylinders relative to the cylinders. The sensor assembly is to sense displacement of a piston relative to its cylinder over time.

7 Claims, 16 Drawing Sheets

U.S. PATENT DOCUMENTS

| | | | |
|---|---|---|---|
| 5,489,249 | A | 2/1996 | Brewer et al. |
| 5,545,112 | A | 8/1996 | Densmore et al. |
| 5,598,849 | A | 2/1997 | Browne |
| 5,723,786 | A | 3/1998 | Klapman |
| 5,769,755 | A | 6/1998 | Henry et al. |
| 5,794,361 | A | 8/1998 | Sadler |
| 5,813,142 | A | 9/1998 | Demon |
| 5,890,997 | A | 4/1999 | Roth |
| 5,916,063 | A | 6/1999 | Alessandri |
| 5,931,763 | A | 8/1999 | Alessandri |
| 5,944,633 | A | 8/1999 | Wittrock |
| 6,032,108 | A | 2/2000 | Seiple et al. |
| 6,155,957 | A | 12/2000 | Worley et al. |
| 6,179,746 | B1 | 1/2001 | Delman |
| 6,193,631 | B1 | 2/2001 | Hickman |
| 6,239,501 | B1 | 5/2001 | Komarechka |
| 6,244,988 | B1 | 6/2001 | Delman |
| 6,251,048 | B1 | 6/2001 | Kaufman |
| 6,255,799 | B1 | 7/2001 | Le et al. |
| 6,315,694 | B1 | 11/2001 | Osu et al. |
| 6,358,187 | B1 | 3/2002 | Smith |
| 6,447,431 | B1 | 9/2002 | Milburn et al. |
| 6,478,736 | B1 | 11/2002 | Mault |
| 6,497,638 | B1 | 12/2002 | Shea |
| 6,503,173 | B2 | 1/2003 | Clem |
| 6,506,142 | B2 | 1/2003 | Itoh et al. |
| 6,516,222 | B2 | 2/2003 | Fukuda |
| 6,527,674 | B1 | 3/2003 | Clem |
| 6,571,200 | B1 | 5/2003 | Mault |
| 6,656,091 | B1 | 12/2003 | Abelbeck |
| 6,659,916 | B1 | 12/2003 | Shea |
| 6,687,535 | B2 | 2/2004 | Hautala et al. |
| 6,702,719 | B1 | 3/2004 | Brown et al. |
| 6,740,007 | B2 | 5/2004 | Gordon et al. |
| 6,743,167 | B2 | 6/2004 | Balkin et al. |
| 6,783,482 | B2 | 8/2004 | Oglesby et al. |
| 6,786,848 | B2 | 9/2004 | Yamashita et al. |
| 6,790,178 | B1 | 9/2004 | Mault et al. |
| 6,793,607 | B2 | 9/2004 | Neil |
| 6,808,473 | B2 | 10/2004 | Hisano et al. |
| 6,824,502 | B1 | 11/2004 | Huang |
| 6,832,109 | B2 | 12/2004 | Nissila |
| 6,836,744 | B1 | 12/2004 | Asphahani et al. |
| 6,863,641 | B1 | 3/2005 | Brown et al. |
| 6,866,613 | B1 | 3/2005 | Brown et al. |
| 6,955,630 | B2 | 10/2005 | Sher |
| 6,991,586 | B2 | 1/2006 | Lapcevic |
| 6,997,852 | B2 | 2/2006 | Watterson et al. |
| 7,022,047 | B2 | 4/2006 | Cohen et al. |
| 7,044,891 | B1 | 5/2006 | Rivera |
| 7,056,265 | B1 | 6/2006 | Shea |
| 7,060,006 | B1 | 6/2006 | Watterson et al. |
| 7,060,008 | B2 | 6/2006 | Watterson et al. |
| 7,070,539 | B2 | 7/2006 | Brown et al. |
| 7,097,588 | B2 | 8/2006 | Watterson et al. |
| 7,107,706 | B1 | 9/2006 | Bailey, Sr. et al. |
| 7,115,076 | B2 | 10/2006 | Oglesby et al. |
| 7,128,693 | B2 | 10/2006 | Brown et al. |
| 7,163,490 | B2 | 1/2007 | Chen |
| 7,166,062 | B1 | 1/2007 | Watterson |
| 7,186,270 | B2 | 3/2007 | Elkins |
| 7,204,041 | B1 | 4/2007 | Bailey, Sr. et al. |
| 7,219,449 | B1 | 5/2007 | Hoffberg et al. |
| 7,254,516 | B2 | 8/2007 | Case, Jr. et al. |
| 7,350,787 | B2 | 4/2008 | Voss |
| 7,354,380 | B2 | 4/2008 | Volpe, Jr. |
| 7,395,614 | B1 | 7/2008 | Bailey, Sr. et al. |
| 2001/0004622 | A1 | 6/2001 | Alessandri |
| 2001/0041647 | A1 | 11/2001 | Itoh et al. |
| 2001/0056241 | A1 | 12/2001 | Nissila |
| 2002/0039952 | A1 | 4/2002 | Clem |
| 2002/0055419 | A1 | 5/2002 | Hinnebusch |
| 2002/0062069 | A1 | 5/2002 | Mault |
| 2002/0107433 | A1 | 8/2002 | Mault |
| 2002/0156351 | A1 | 10/2002 | Sagel |
| 2003/0130595 | A1 | 7/2003 | Mault |
| 2003/0211916 | A1 | 11/2003 | Capuano |
| 2004/0077462 | A1 | 4/2004 | Brown |
| 2004/0082439 | A1* | 4/2004 | Johnston et al. ..... 482/8 |
| 2004/0102684 | A1 | 5/2004 | Kawanishi et al. |
| 2004/0138583 | A1 | 7/2004 | Galea |
| 2004/0147814 | A1 | 7/2004 | Zancho et al. |
| 2004/0176226 | A1 | 9/2004 | Carlson |
| 2005/0015118 | A1 | 1/2005 | Davis et al. |
| 2005/0113650 | A1 | 5/2005 | Pacione et al. |
| 2005/0184878 | A1 | 8/2005 | Grold et al. |
| 2005/0233859 | A1 | 10/2005 | Takai et al. |
| 2005/0261609 | A1 | 11/2005 | Collings et al. |
| 2005/0283205 | A1 | 12/2005 | Lee et al. |
| 2006/0079800 | A1 | 4/2006 | Martikka et al. |
| 2006/0189440 | A1* | 8/2006 | Gravagne ..... 482/8 |
| 2006/0252608 | A1* | 11/2006 | Kang et al. ..... 482/84 |
| 2007/0179359 | A1 | 8/2007 | Goodwin |
| 2008/0214903 | A1 | 9/2008 | Orbach |
| 2009/0240305 | A1 | 9/2009 | Lee et al. |

FOREIGN PATENT DOCUMENTS

| | | |
|---|---|---|
| EP | 1334693 | 8/2003 |
| EP | 1391179 | 2/2004 |
| WO | WO-0200111 | 1/2002 |
| WO | WO-03045232 | 6/2003 |

OTHER PUBLICATIONS

Long, Robert F. , Non-Final Office Action for U.S. Appl. No. 11/737,981, Mar. 20, 2009.

Richman, Glenn E. , Restriction Requirement for U.S. Appl. No. 11/738,007, Jun. 9, 2009.

Long, Robert F. , First Office Action for U.S. Appl. No. 11/737,999, Sep. 8, 2008.

Long, Robert F. , First Office Action for U.S. Appl. No. 11/737,970, Aug. 21, 2008.

Long, Robert F. , First Office Action for U.S. Appl. No. 11/737,981, Aug. 20, 2008.

Dherve, Gwenaelle , "EESR", Extended European Search Report for EP 05797101.2, Feb. 2, 2008.

Long, Robert F. , Third Office Action for U.S. Appl. No. 11/737,981, Jan. 8, 2010.

Long, Robert F. , Third Office Action for U.S. Appl. No. 11/737,970, Sep. 30, 2009.

Richman, Glenn E. , Second Office Action for U.S. Appl. No. 11/738,007, Oct. 19, 2009.

Schwenke, Stephanie, Extended European Search Report for EP 05799052.5, Aug. 6, 2009.

Long, Robert F. , Fourth Office Action for U.S. Appl. No. 11/737,970, Jun. 10, 2010.

Richman, Glenn E. , Third Office Action for U.S. Appl. No. 11/738,007, May 28, 2010.

* cited by examiner

HYDRAULIC EXERCISE MACHINE SYSTEM AND METHODS THEREOF

CROSS-REFERENCE TO RELATED APPLICATIONS

This is a continuation-in-part application claiming the benefit under 35 USC 120 and 35 USC 365(c) of International Application No. PCT/CA2005/001620 entitled "Method of Characterizing Physical Performance", which was filed Oct. 24, 2005 and which is incorporated herein by reference, and which itself claims the benefit of U.S. Provisional Patent Application No. 60/620,679 entitled "Automated Human Performance System", which was filed Oct. 22, 2004 and of U.S. Provisional Patent Application No. 60/680,474 entitled "Mytrak System", which was filed May 13, 2005, both of which are incorporated herein by reference. This is also a continuation-in-part application claiming the benefit under 35 USC 120 and 35 USC 365(c) of International Application No. PCT/CA2005/001626 entitled "System for Measuring Physical Performance and for Providing Interactive Feedback", which was filed Oct. 24, 2005 and which is incorporated herein by reference, and which itself claims the benefit of U.S. Provisional Patent Application No. 60/620,679 and of U.S. Provisional Patent Application No. 60/680,474.

BACKGROUND

When people exercise, either at home or in a fitness club, they usually have some goal in mind, such as getting fitter, staying fit, increasing strength, losing weight, etc. To get the most benefit from exercise it is important that people know exactly what goal they have been set and how they are performing, both on an immediate real-time basis and over time. This leaves the person who has exercised with a number of key questions: How well have I done? How much energy did I exert and how many calories did I burn? Did I perform well against my target or exercise program? What was my target? Did I do better this time, compared to last time or my historical data? Am I improving and progressing my fitness level? Exactly how fit am I?

The current method of establishing a person's absolute maximum performance on any given piece of exercise equipment is to get that person to exercise to exhaustion while measuring the parameters of interest: heart rate, oxygen consumption, weight lifted, etc. This data provides an individual's maximum performance at that point in time i.e. the individual's 100% output or ability. However this may be only 60% of the standard for that individual's age or sex. Such standards (high, average, poor, etc) are available for aerobic fitness (VO2max) as established on a treadmill, bicycle, or step test and some physical performance tests.

This method, for most people, is impractical, since as you are improving in fitness, you would be required to retake the tests to track any change in fitness level.

Some current computer-based solutions for fitness training are essentially electronic versions of a performance card on which measured repetition and set data (for weight stack exercise machines) is stored and possibly compared to a target value. The feedback provided is minimal, and only provides information relating to targets for sets and repetitions, not in terms of overall health targets.

BRIEF DESCRIPTION OF THE DRAWINGS

Embodiments are illustrated by way of example and not limitation in the figures of the accompanying drawings, in which like reference numerals indicate corresponding, analogous or similar elements, and in which.

DETAILED DESCRIPTION

In the following detailed description, numerous specific details are set forth in order to provide a thorough understanding of embodiments. However it will be understood by those of ordinary skill in the art that the embodiments may be practiced without these specific details. In other instances, well-known methods, procedures, components and circuits have not been described in detail so as not to obscure the embodiments.

Figure 1:
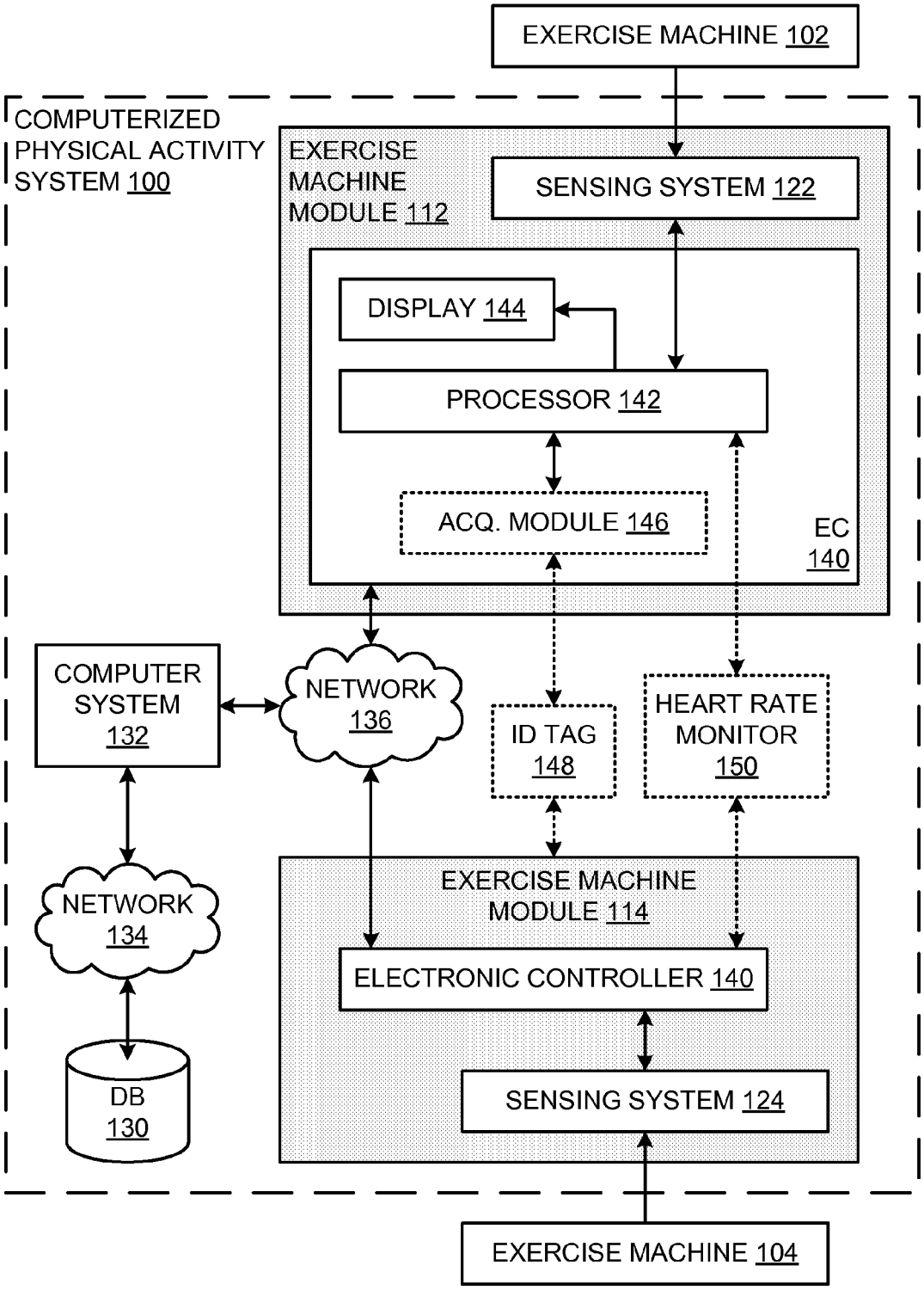
FIG. 1 is a block diagram of an exemplary computerized physical activity system.

FIG. 1 is a block diagram of a computerized physical activity system 100 for use with exercise machines, of which two are shown, exercise machine 102 and exercise machine 104. Different exercise machines may be used with system 100, including, for example, weight stack exercise machines, hydraulic or pneumatic exercise machines, spinning exercise machines and other cardio machines such as treadmills, elliptical machines, stepping machines, manual and electronic bicycles and the like. In this description and claims, the terms "hydraulic exercise machine" and "hydraulic cylinder" are expanded to include also "pneumatic exercise machine" and "pneumatic cylinder", respectively. Likewise, in the description and claims, the term "liquid" used in the context of hydraulic exercise machines, hydraulic cylinders, pneumatic exercise machines and pneumatic cylinders is expanded to include also "air or other gas". System 100 comprises an exercise machine module for each of the exercise machines, and exercise machine module 112 for exercise machine 102 and exercise machine module 114 for exercise machine 104 are shown.

Although system 100 is described herein as being for use with two or more exercise machines, it will be obvious to a person of ordinary skill in the art how to modify the system for use with a single exercise machine.

Each exercise machine module comprises a sensing system coupled to the exercise machine to sense mechanical variables of activities of a person when exercising on the exercise machine. Exercise machine module 112 comprises a sensing system 122 coupled to exercise machine 102, and exercise machine module 114 comprises a sensing system 124. Different sensing systems may be used for different types and classes of exercise machines, and may involve load cells, infrared position detectors, optical encodes, potentiometers, magnets, pressure foil mechanisms and other sensors. Sensing systems for use with weight-stack exercise machines, sensing systems for use with hydraulic or pneumatic exercise machines, and sensing systems for use with spinning exercise machines are discussed in more detail hereinbelow. Even within a single class of exercise machines, for example, weight-stack exercise machines, different sensing systems may be used for different types of exercise machines. For example, a leg press exercise machine may have a different sensing system coupled to it than an outer thigh exercise machine.

Although the exercise machines are described herein as being external to system 100, with a sensing system possibly retrofitted to an existing exercise machine, it will be obvious to a person of ordinary skill in the art that system 100 may comprise one or more exercise machines in which some or all of the exercise machine module is integrated with the exercise machine.

System 100 comprises a database 130 storing information about people who will be using the system, and a computer and communication system coupled to database 130 and to the sensing systems. The computer and communication system is arranged to process mechanical properties of the exercise machines and the mechanical variables of the activities to generate user performance data for each of the activities, to perform an analysis of the user performance data based, at least in part, on information stored in database 130 for the person, to provide feedback to the person when exercising on one of the exercise machines based on the user performance data and/or the analysis thereof for the activity of the person on the one of the exercise machines, and to update the information stored in database 130 for the person based on the analysis so that subsequent analyses of user performance data for activities of the person are performed based, at least in part, on the updated information. Therefore, if a person exercises on exercise machine 102 and then on exercise machine 104, the analysis of the person's activity on exercise machine 102 may be taken into account when analyzing the person's activity on exercise machine 104.

In the example shown in FIG. 1, the computer and communication system comprises a computer system 132 coupled to database 130 and to electronic controllers 140 that are comprised in the exercise machine modules. Computer system 132 may be a centralized computer system or a distributed computer system. The communication between computer system 132 and database 130 may be wired, wireless or optical or any combination thereof and may be conducted via a network 134. The communication between computer system 132 and electronic controllers 140 may be wired, wireless or optical or any combination thereof and may be conducted via a network 136.

Electronic controller 140 comprises a processor 142 coupled to the sensing system and is arranged to handle at least a portion of the processing of the mechanical variables. Electronic controller 140 also comprises a feedback unit coupled to processor 142 for providing the feedback to the person who is exercising. In the example shown in FIG. 1, the feedback unit is a display 144, which may comprise, for example, a screen and/or various light emitting diode (LED) lights. Display 144 is viewable by the person when exercising on the exercise machine and the computer and communication system may be arranged to show on display 144 visual feedback related to the user performance data and/or the analysis thereof. The computer and communication system may be arranged to show on display 144 an indication of another exercise machine to which the person, after exercising on this exercise machine, should proceed according to an exercise program for the person stored in database 130. Audio feedback is also contemplated, although it is not shown in FIG. 1.

As mentioned above, the analysis of the user performance data performed by the computer and communication system is based, at least in part, on information stored in database 130 for the person. The computer and communication system therefore needs identification of the person who is currently exercising on the exercise machine. Once computer system 132 identifies the person, it may retrieve the information from database 130. If the analysis is done solely by computer system 132, there may be no need to provide any of the retrieved information to electronic controller 140. If the analysis is done partly by computer system 132 and partly by electronic controller 140, computer system 132 may provide some or all of the retrieved information to electronic controller.

Computer system 132 may identify the person without any interaction with electronic controller 140. For example, a trainer in an exercise facility may input to computer system 132 which person is currently exercising on the exercise machine. Alternatively, electronic controller 140 may comprise an acquisition module 146 near or affixed to the exercise machine to acquire an identifier of the person. For example, the person may enter a personal identification number (PIN) into a user input component (not shown). In another example, the person may have a tag 148 storing the identifier of the person and acquisition module 146 may acquire the identifier from tag 148. For example, tag 148 may be a radio frequency identifier (RFID) tag. In another example, tag 148 may have a microchip or a magnetic stripe and may be inserted into an appropriate tag reader (not shown). In yet another example, tag 148 may have a bar code and acquisition module 146 may comprise a bar code reader (not shown). The person's identifier, once acquired by acquisition module 146, may be provided to computer system 132 so that all or a portion of the information stored in database 130 for the person may be retrieved by computer system 132 and optionally provided to electronic controller 140.

At least one of electronic controllers 140 may be able to receive heart rate data of the person from a heart rate monitor 150 that is worn or otherwise coupled to the person when exercising on the exercise machine. For example, heart rate monitor 150 may be integrated into the exercise machine, as is known in the art. Database 130 may store target heart rate zone information for the person, and electronic controller 140 (or computer system 132) may process the heart rate data based on the target heart rate zone information. The feedback provided to the user may be based on the results of this processing. For example, display 144 may show a visual indication of a comparison of the person's heart rate and the target heart rate zone.

The information stored in database 130 may include, for example, historical workout results, exercise programs, human performance physical profiles, training activity, achieved results, dietary information and various predictive analysis and algorithms, a person's physical performance targets or goals (or exercise/fitness targets or goals), specific fitness/health data for the person (e.g. the body's energy burn rate, caloric intake data, etc.), as well as user performance data.

For example, the analysis of the user performance data may be based, at least in part, on caloric intake information for the person and/or on exercise targets for the person.

Figure 2:
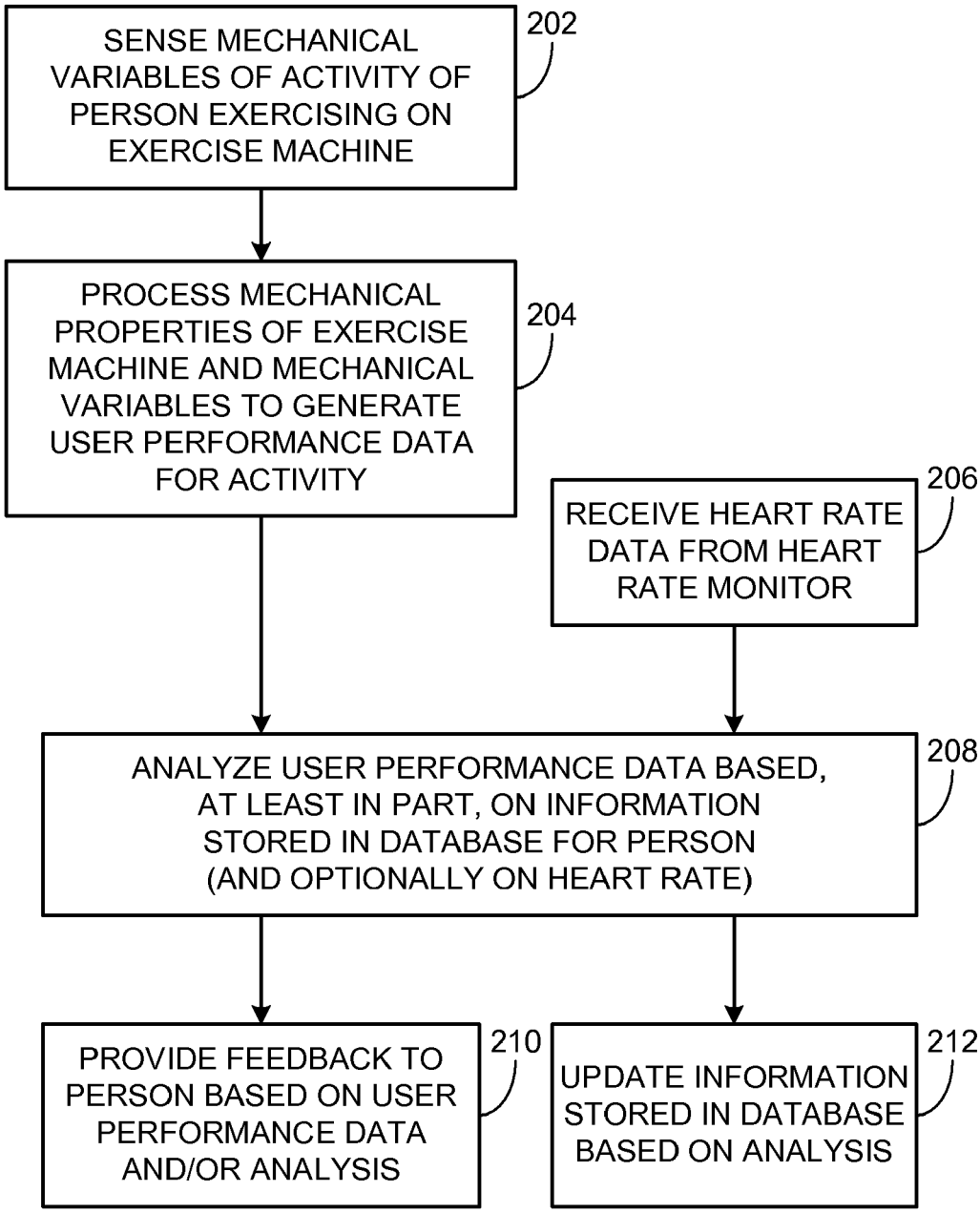
FIG. 2 is a flowchart of an exemplary method for providing feedback to a person who is exercising.

FIG. 2 is a flowchart of an exemplary method for providing feedback to a person who is exercising. A sensing system senses at 202 mechanical variables of an activity of the person when exercising on an exercise machine. The mechanical variables are processed at 204 together with mechanical properties of the exercise machines to generate user performance data for the activity. Optionally, heart rate data of the person while exercising on the exercise machine is received at 206 from a heart rate monitor. At 208, the user performance data is analyzed based, at least in part, on information stored in a database for the person (and optionally on the heart rate data received at 206). Feedback based on the user performance data and/or analysis thereof is provided to the person at 210. The information in the database is updated at 212 based on the analysis, so that subsequent analyses of user performance data, whether on the same exercise machine or on a different exercise machine, is based, at least in part, on the updated information.

Examples of the user performance data for an activity include one or more of the following: the force required to move one or more physical components of the exercise machine during the activity, the energy exerted by the person while exercising on the exercise machine, the workout intensity, the range of motion of the activity, the speed of one or more physical components of the exercise machine during the activity, the distance one or more physical components of the exercise machine have been displaced over a period of time during the activity, and the acceleration of one or more physical components of the exercise machine during the activity.

The information stored in database 131 for the person may include a target workout intensity for the activity, and the feedback provided to the person may include an indication to increase, sustain or decrease the workout intensity based on a comparison of the calculated workout intensity and the target workout intensity. For example, the feedback may be provided via a LED light bar, which displays a first color (e.g. yellow) if the indication is to increase the workout intensity, displays a second color (e.g. green) if the indication is to sustain the workout intensity, and displays a third color (e.g. red) if the indication is to decrease the workout intensity. For example, a traffic-light analogy may be achieved by use of the colors yellow, green and red, as described above.

Figure 3:
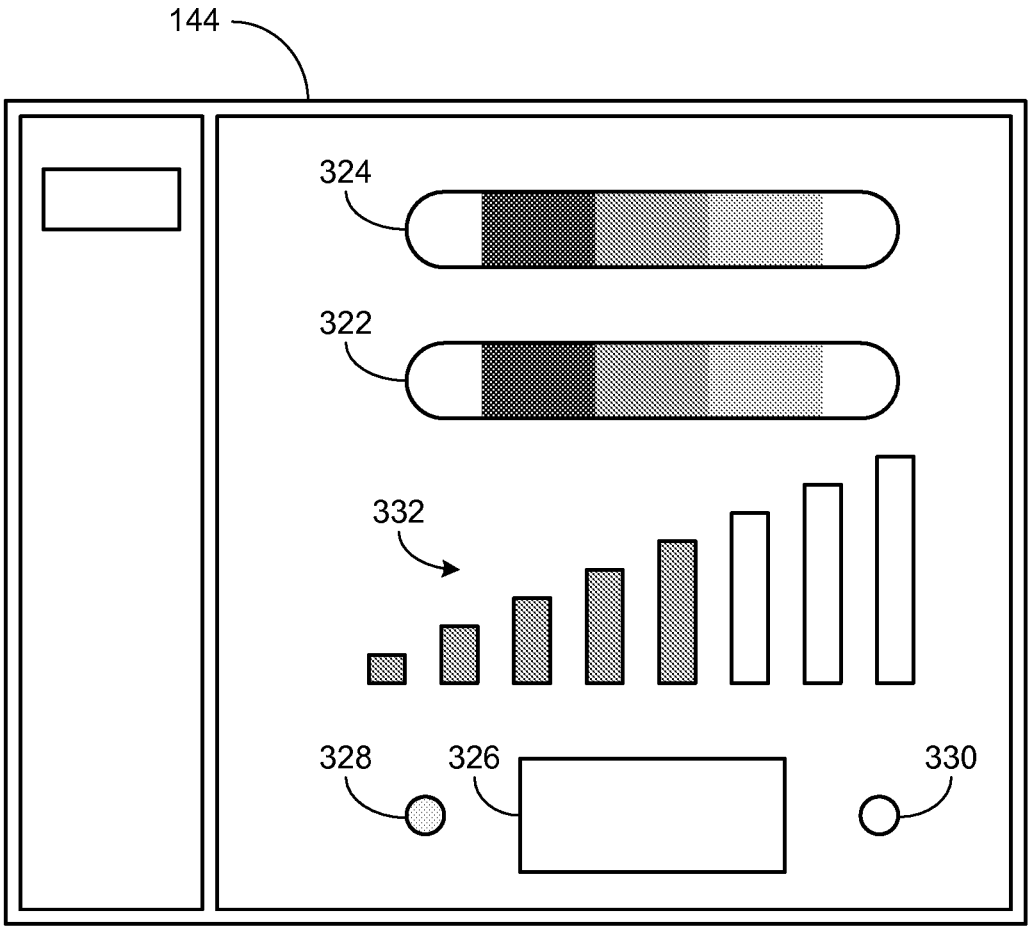
FIG. 3 is an illustration of an exemplary display on which feedback is provided to the person who is exercising.

FIG. 3 illustrates an example of display 144. Display 144 comprises a LED light bar for display of user performance, or outcome summaries. The display may include an indication of one or more of the following parameters: prescribed workout intensity; prescribed target heart rate; achieved heart rate; achieved workout intensity. The feedback module can also indicate information such as time, reps, sets, load, power, or any other piece of data that is measured by the sensor(s), or is derivable from the measured data. In the example shown in FIG. 3, display 144 comprises an indicator 322 of physical performance or workout intensity, which provides user-specific feedback on physical performance or workout intensity based on a comparison of measured user performance and a stored user target. A heart rate performance feedback indicator 324 can similarly provide user-specific feedback on heart rate based on a comparison of measured heart rate data and a stored target heart rate zone.

This LED feedback indicates to the user to increase, decrease or sustain the current level of workout in order to reach the desired goals. When one of the intensity, or physical performance, indicators flashes green, this indicates that the person has reached the target energy burn rate, or is training at the appropriate intensity level required to achieve the desired weight loss/gain goals. If the person were wearing a heart rate monitor, the heart rate would be displayed on the electronic controller.

An information display 326 can provide additional information to the user. For example, when a heart rate measure indicator 328 is activated, the information display can indicate an actual measured heart rate value, such as a numeric value. When a repetitions, or reps, indicator 330 is activated, the information display may indicate a number of repetitions performed by the user. When neither of those two indicators is activated, the information display 326 may indicate to the user, at the end of a workout on that exercise machine, to which exercise machine to proceed to next according to the person's exercise program. The same information display can also display a number of sets performed by the user. A range of motion indicator 332 indicates a range of motion value based on measured user performance. As shown in FIG. 3, range of motion indicator 322 can be implemented as a progressive indicator, showing a portion or percentage of range of motion achieved. Alternatively, the range of motion could be displayed as a numerical percentage in the information display 326.

Weight-Stack Exercise Machine

A weight-stack exercise machine comprises a stack of weights that is lifted as the person exercising on the exercise machine moves one or more physical components of the exercise machine. The sensing system may comprise one or more load cells coupled to the portion of the stack that is lifted, and/or may comprise one or more load cells coupled to the portion of the stack that remains when one or more of the weights are lifted. Alternatively, or additionally, the sensing system may comprise one or more sensors to sense which weights have been lifted. The sensing system may comprise one or more sensors to sense a distance that the weights have been displaced (e.g. a counter to count rotations of a wheel over which a cable attached to the weights moves), or to sense a velocity or an acceleration of the weights or other physical component of the exercise machine. From this sensed information, the computer and communication system may determine the user performance data as described hereinabove.

Hydraulic Exercise Machine

A hydraulic exercise machine is any exercise machine that uses one or more hydraulic cylinders for resistance. Some examples of hydraulic exercise machines include rowing machines, steppers, and other machines. A hydraulic exercise machine uses an isokinetic form of resistance; the harder you push, the more resistance the hydraulic piston gives you. One of the ideas behind hydraulic training is to push as hard as you can and train as hard as you can, then the machine will resist you proportionately based on your exertion. However, while the person is pushing as hard as she can, the person is not aware of how much energy she is exerting, and whether the energy exerted is enough or too much with respect to a desired training program.

A hydraulic exercise machine system comprises one or more hydraulic cylinders, a mechanism coupled to at least one of the hydraulic cylinders and a sensor assembly. Displacement of the mechanism by a person exercising on the hydraulic exercise machine displaces pistons of the hydraulic cylinders relative to the cylinders, either by causing the pistons to move or by causing the cylinders to move. The sensor assembly senses the relative displacement of a piston relative to its cylinder over time. The hydraulic exercise machine system may further comprise electronic means for analyzing data from the sensor assembly, for example, electronic controller 140 or portions thereof. The hydraulic exercise machine system may comprise a display, for example, display 144, to provide visual feedback to the person based, at least in part, on the analyzed data.

Figure 4A:
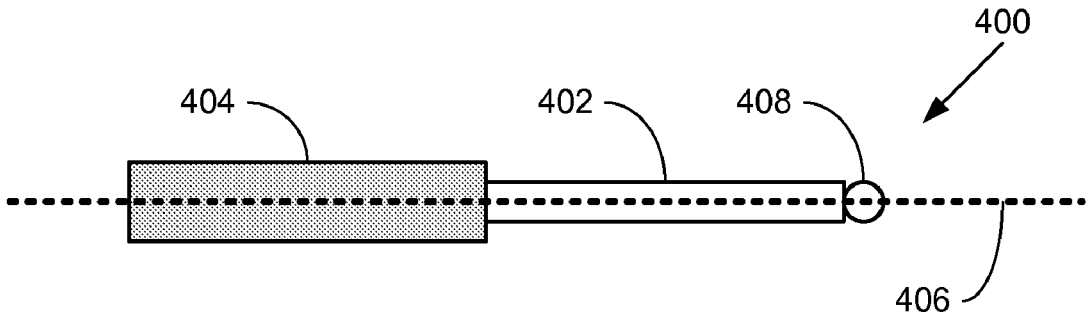
FIG. 4A is a side view of an exemplary hydraulic cylinder.

FIG. 4A is a side view of an exemplary hydraulic cylinder 400. A piston 402 is able to be displaced relative to a cylinder 404 along an axis 406. Liquid or gas is trapped in cylinder 404 by piston 402. An attachment 408 to piston 402 may be coupled to a mechanism that can be displaced by a person exercising on the hydraulic exercise machine.

Figure 4B:
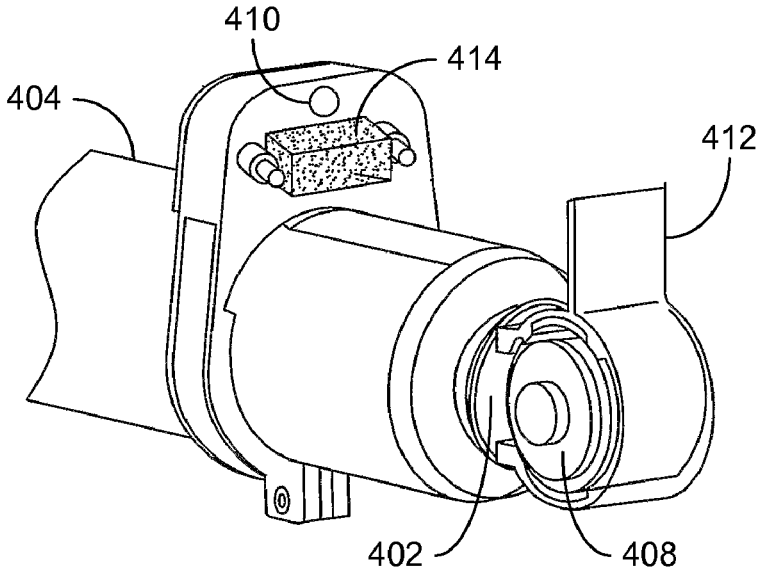
FIG. 4B is a perspective view of an exemplary hydraulic cylinder with a sensor assembly coupled thereto.

FIG. 4B is a perspective view of hydraulic cylinder 400 with a sensor assembly coupled thereto to sense displacement of piston 402 relative to cylinder 404 over time. Infrared, visible light or other radiation emitted from a source 410 is reflected by a reflector 412 and the reflected radiation is detected by a radiation detector 414. As piston 402 and cylinder 404 are displaced relative to each other over time, the distance between source 410 and reflector 412 varies, and the distance between reflector 412 and detector 414 varies. Although the sensor assembly (comprising source 410, reflector 412 and detector 414) is shown in FIG. 4B external to cylinder 404, a similar assembly could be implemented internal to cylinder 404.

Figure 5:
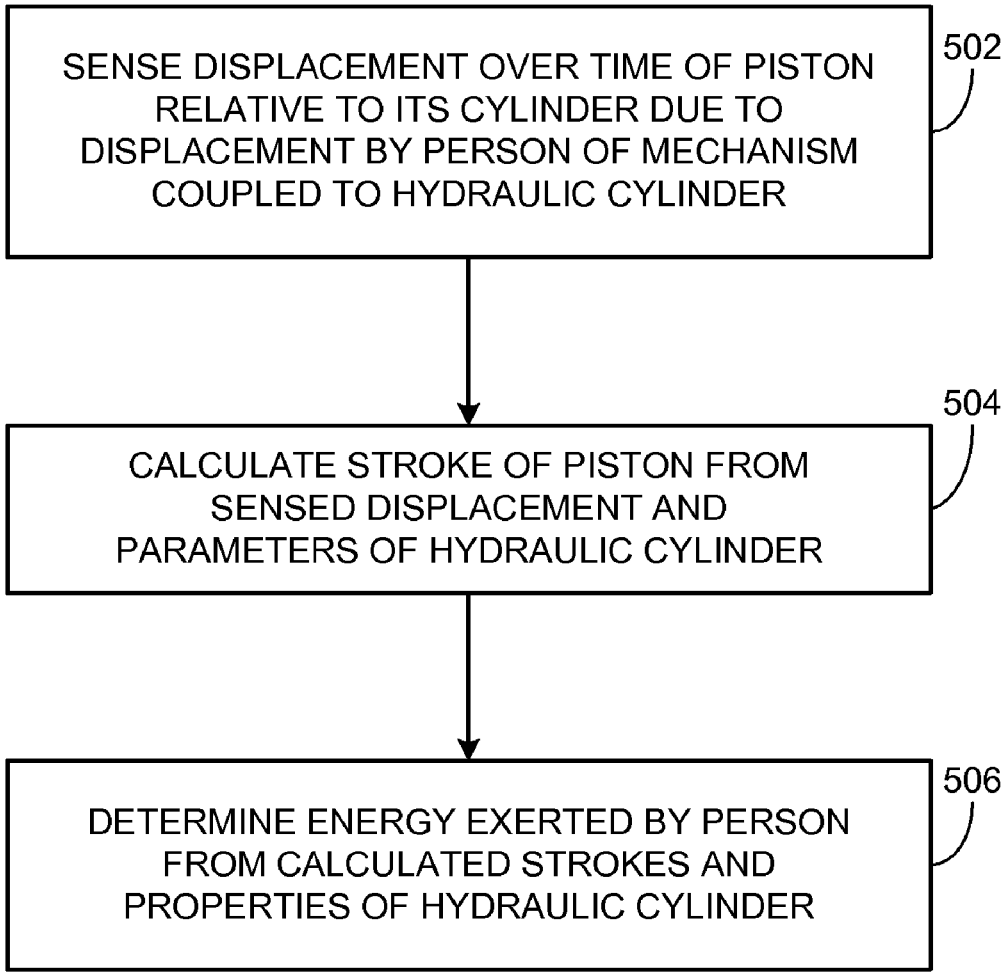
FIG. 5 is a flowchart of an exemplary method for determining energy exerted by a person exercising on a hydraulic exercise machine.

FIG. 5 is a flowchart of an exemplary method for determining energy exerted by a person exercising on a hydraulic exercise machine. A sensing system or sensor assembly senses at 502 displacement over time of a piston of the hydraulic exercise machine relative to its cylinder due to displacement by the person of a mechanism coupled to the hydraulic cylinder. A stroke of the piston is calculated at 504 from the sensed displacement and parameters of the hydraulic cylinder. The energy exerted by the person while displacing the mechanism is determined at 506 based, at least in part, on the calculated stroke and properties of the hydraulic cylinder.

Figure 6:
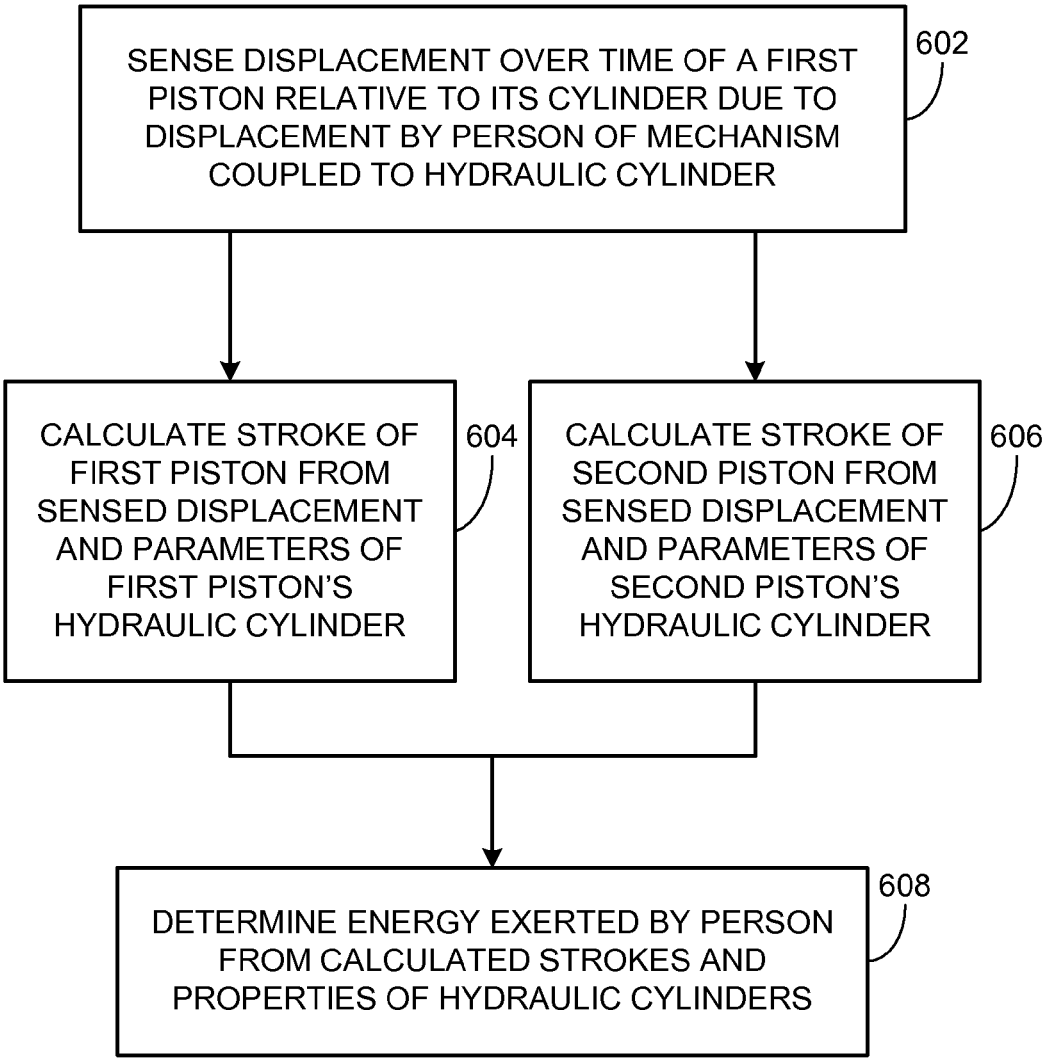
FIG. 6 is a flowchart of an exemplary method for determining energy exerted by a person exercising on a hydraulic exercise machine in which a first piston and a second piston are coupled.

FIG. 6 is a flowchart of an exemplary method for determining energy exerted by a person exercising on a hydraulic exercise machine in which a first piston and a second piston are coupled. A sensing system or sensor assembly senses at 602 displacement over time of the first piston of the hydraulic exercise machine relative to its cylinder due to displacement by the person of a mechanism coupled to the hydraulic cylinder. A stroke of the first piston is calculated at 604 from the sensed displacement and parameters of the first piston's hydraulic cylinder. A stroke of the second piston is calculated at 606 from the sensed displacement and parameters of the second piston's hydraulic cylinder. The energy exerted by the person while displacing the mechanism is determined at 608 based, at least in part, on the calculated strokes and properties of the hydraulic cylinders.

The parameters and properties of the hydraulic cylinders used to calculate the strokes and determine the energy exerted comprise one or more of the following: viscosity of a liquid or gas used in the hydraulic cylinder, a size of an orifice of the piston, and force required to move the liquid or gas through the orifice.

Each cylinder has a particular characteristic that relates piston velocity to the force required to move the piston relative to the cylinder. This can be measured on a dynamometer and approximated to a polynomial equation of the form:

$$F=av^2+bv+c$$

where F is the force and v is the velocity. Over the low velocity range that the cylinder is used, with a maximum of approximately 10 mm/sec, this can be approximated to a straight line, therefore the equation becomes:

$$F=fv$$

where f is the force factor for a particular cylinder direction and setting. For example, if the velocity is in units of millimeters per second, and the force is in units of Newtons (N), the force factor has units of N/mm. If the cylinder is configured where the force is different in the forward and reverse directions, two force factors are required.

In addition, each piston may have multiple settings through the adjustment of a bleed valve. Each of these bleed valve or "hardness" settings corresponds to a different force factor value.

The energy E required to displace a piston relative to its cylinder over a distance d in time t is given by the following equation:

$$E=Fd=f(d^2/t)$$

Figure 7A:
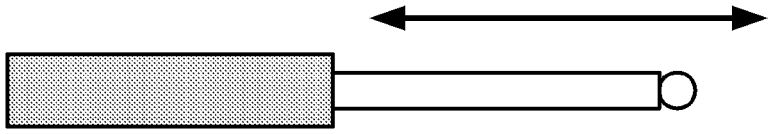
FIGS. 7A, 7B and 7C are illustrations of three types of hydraulic cylinder configurations.
Figure 7B:
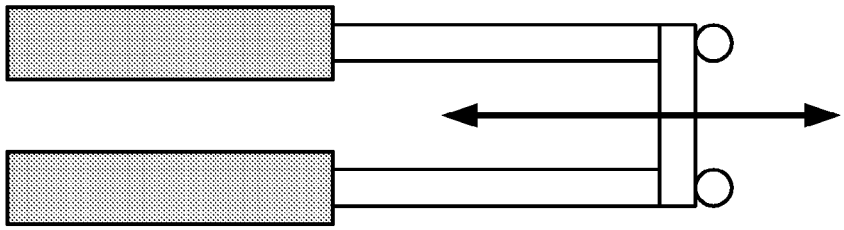
Figure 7C:
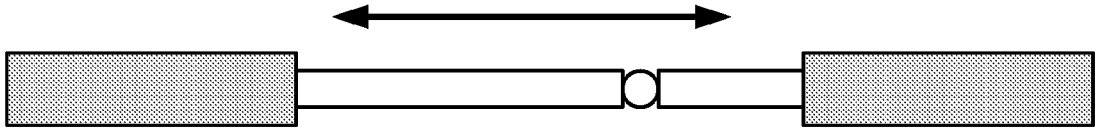

Exercise machines with hydraulic cylinders fall into a number of different categories based on how the cylinders are configured. Categorizing the machine in this way enables one equation to be used for the energy calculations. FIGS. 7A-7C illustrate three types of hydraulic cylinder configurations.

The forward and reverse force factors for the machines can be calculated as follows:

Type 1: Single cylinder machine (shown in FIG. 7A)

$$f_{FWD}=CYL_{FWD}$$

$$f_{REV}=CYL_{REV}$$

Type 2: Dual cylinder machine with cylinders working in the same direction (shown in FIG. 7B)

$$f_{FWD}=CYL1_{FWD}+CYL2_{FWD}$$

$$f_{REV}=CYL1_{REV}+CYL2_{REV}$$

Type 3: Dual cylinder machine with opposing motion (shown in FIG. 7C)

$$f_{FWD}=CYL1_{FWD}+CYL2_{REV}$$

$$f_{REV}=CYL1_{REV}+CYL2_{FWD}$$

Therefore, the mechanical properties of the exercise machines that are processed with the sensed mechanical variables may include information relating to the category of the hydraulic exercise machines, the forward and reverse force factors at one or more valve settings, and the like.

Likewise, the distance measuring device has specific characteristics and may be non-linear. Some devices may not measure from zero, so the stroke minimum and stroke maximum may also be included in the mechanical properties of the exercise machines that are processed.

Spinning Exercise Machine

Spinning exercise machines are intended more for cardiovascular conditioning than strength. Exercise is performed on one piece of equipment for a considerably longer time than on a weight stack exercise machine or a hydraulic exercise machine. A typical spinning workout may last 20 to 45 minutes. Typical example workouts are as follows:

| Level | Workout Time (min) | Cardio Zone (% maximum heart rate) | Bike Speed (rpm) | Bike Resistance (max 20) |
|---|---|---|---|---|
| Beginner | 20 | 55 to 65 | 40 to 60 | 3 to 6 |
| Intermediate | 30 | 65 to 75 | 60 to 80 | 7 to 12 |
| Weight Loss | 20 to 30 | 55 to 65 | 40 to 50 | 1 to 4 |

Any particular workout may involve changes in speed and/or resistance at different times in the workout. For example, a workout may begin and end with lower speeds and lower resistance for warm up and cool down, and may involve higher speeds and higher resistance in the middle. In another example, a workout may alternate periods of low resistance with periods of high resistance.

A spinning exercise machine has a flywheel that rotates as the person exercising on the spinning exercise machine pedals. The spinning exercise machine has various resistance settings, which may be adjusted by the person.

Figure 8:
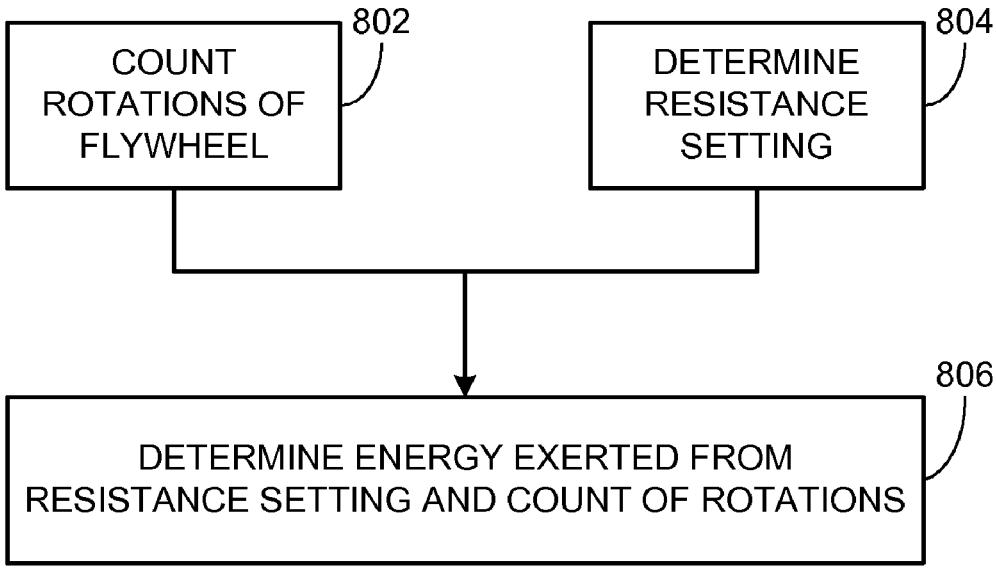
FIG. 8 is a flowchart of an exemplary method for determining the energy exerted by a person while exercising on a spinning exercise machine.

FIG. 8 is a flowchart of an exemplary method for determining the energy exerted by a person while exercising on a spinning exercise machine. At 802, the rotations of the flywheel due to activity of the person are counted. For example, counting the rotations may be accomplished by using an optical position sensor to measure changes in the rotation of the flywheel. In another example, counting the rotations may be applied by using a magnet applied to the flywheel and a Hall-effect sensor applied to a stationary element of the spinning exercise machine. Alternatively, the Hall-effect sensor may be applied to the flywheel and the magnet to a stationary element of the spinning exercise machine.

At 804, a resistance setting of the spinning exercise machine is determined. The resistance setting may be assumed (for example, if the person is following an exercise program that indicates that the resistance should be set to a particular setting) or may be sensed. Some spinning exercise machines use a friction pad that is spring loaded against the flywheel as the means to adjust the resistance. The resistance setting may be determined by sensing the pressure on the friction pad, for example, by using a pressure foil mechanism mounted between a plastic portion of the friction pad and a felt portion of the friction pad, which measures the pressure on the surface area of the friction pad.

At 806, the energy exerted by the person may be determined from the resistance setting and the count of rotations. The count of rotations, flywheel parameters and the time over which the count was taken may be used to calculate an equivalent distance traveled if the person was on a road bike.

Spinning is an exercise often done in classes. While the computerized physical activity system and method described in general hereinabove with respect to FIGS. 1-3 may be used with spinning exercise machines, a simplified version of the system may be used in spinning classes. For example, a computerized spinning exercise system may comprise spinning exercise machines, a sensing system coupled to each spinning exercise machine to count rotations of the flywheel, and a computer and communication system coupled to the sensing systems to process for each spinning exercise machine the count of rotations, the resistance setting and mechanical properties of the spinning exercise machines (e.g. size of flywheel) to generate user performance data for the activity on the spinning exercise machine. The user performance data may include, for example, one or more of the following: the speed of the flywheel during the activity, the distance "traveled" during the activity, and the energy exerted by the person while exercising on the spinning exercise machine. As described hereinabove with respect to FIG. 8, the resistance setting may be assumed or sensed.

The computer and communication system may be arranged to display to a trainer of the spinning class visual feedback related to the user performance data for the people in the class. This will enable the trainer to see the results in real time. For example, the feedback may be displayed on the wall with a projector. This would allow the trainer to focus on individual performance and generate a competitive atmosphere. Audio feedback is also contemplated.

If the system includes access to a database storing information about the people using the computerized spinning exercise system, then analysis of the user performance data may be performed based, at least in part, on the information. The feedback may be related to the analysis of the user performance data.

Characterizing Fitness

People who exercise may want to know how fit they are and to what extent their performance while exercising contributes to their overall fitness in view of fitness goals. The systems and methods described hereinabove involve determining the energy exerted by a person while exercising on an exercise machine, which is key to characterizing the person's fitness.

Figure 9:
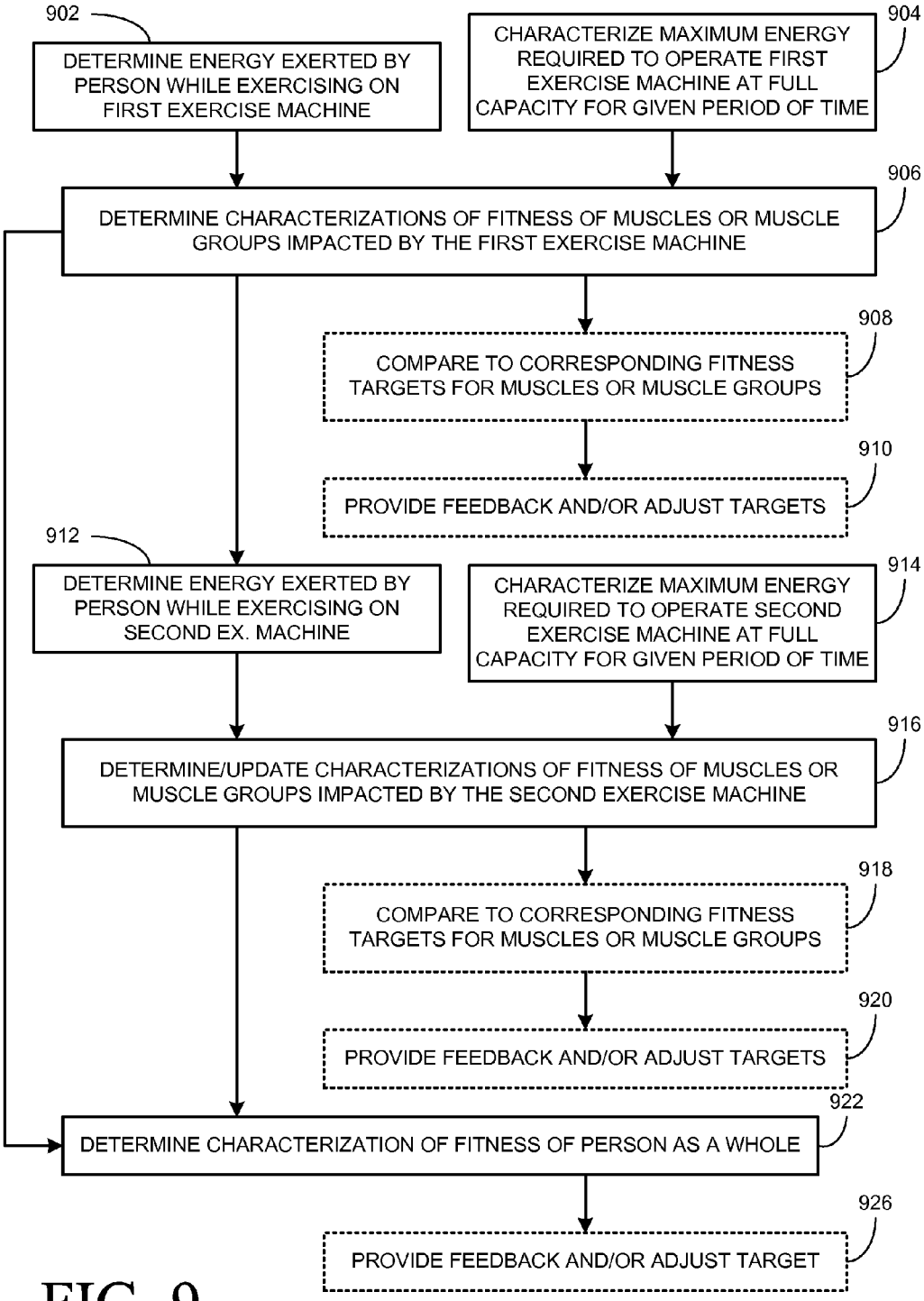
FIG. 9 is a flowchart of an exemplary method of characterizing fitness.

FIG. 9 is a flowchart of an exemplary method of characterizing fitness. This method may be implemented by the computer and communication system of system 100. At 902, the energy exerted by a person while exercising on a first exercise machine is determined.

Since the first exercise machine impacts one or more muscles and/or muscle groups of the musculoskeletal system of the person, characterizations of the fitness of the one or more muscles and/or muscle groups are determined at 906 based, at least in part, on the energy exerted. For example, a particular exercise machine may impact the back muscles, trapezoid muscles, shoulder muscles, biceps and triceps of the person. A percentage or ratio may be assigned to each impacted muscle or muscle group, as part of the characterization of the exercise machine. The characterization of a particular muscle or muscle group will then be based, at least in part, on the percentage of the energy exerted that corresponds to the particular muscle or muscle group.

Determining the characterizations of the fitness of the one or more muscles and/or muscle groups is based, at least in part, on a characterization of the maximum energy that would be required to operate the first exercise machine at full capacity for a given period of time. This maximum energy may be referred to as the "machine maximum energy value". This characterization is shown in FIG. 9 at 904, but will likely be done once per exercise machine or type of exercise machine and need not be repeated each time a person exercises on the exercise machine.

An exercise machine may have inherent inefficiencies, such that some of the energy exerted by the person is "wasted". Alternatively an exercise machine may have inherent advantages (e.g. due to the use of levers and/or pulleys), such that the effect of the activity by the person is enhanced or amplified. The energy exerted by the person, as determined at 902, may be proportional to a machine constant that takes into account inefficiencies and/or mechanical advantages inherent to the first exercise machine.

The characterizations of fitness of the one or more muscles and/or muscle groups may optionally be compared at 908 to one or more corresponding fitness targets for the one or more muscles and/or muscle groups. The fitness targets may be part of the information stored in the database about the person. Feedback may be provided at 910 to the person of how well the person is achieving one or more of the fitness targets. The feedback may be provided while the person is exercising on the first exercise machine and/or at a later time. Alternatively, or in addition, one or more of the fitness targets may be automatically adjusted at 910 based on the comparison. For example, if a person has achieved a fitness target for a particular muscle and/or muscle group, that fitness target and/or the fitness target for the opposing muscle or muscle group may be automatically adjusted to assist the person in achieving the overall goals.

A person is likely to exercise on more than one exercise machine, possibly in the same workout or alternatively, in different workouts. At 912, the energy exerted by a person while exercising on a second exercise machine is determined.

The second exercise machine may be the same as the first exercise machine, or may be a different exercise machine. For example, the first exercise machine may be a chest press hydraulic exercise machine, and the second exercise machine may be a bicep/tricep hydraulic exercise machine. The second exercise machine may even be of a different class than the first exercise machine. For example, the first exercise machine may be a leg press hydraulic exercise machine and the second exercise machine may be lat pulldown weight stack machine.

Characterizations of the fitness of the one or more muscles and/or muscle groups impacted by the second exercise machine are determined at 916 based, at least in part, on the energy exerted while exercising on the second exercise machine. For those muscles and/or muscle groups for which previous characterizations of fitness have been determined, the characterization is updated at 916 based, at least in part, on the energy exerted while exercising on the second exercise machine.

As before, determining the characterizations of the fitness of the one or more muscles and/or muscle groups at 916 is based, at least in part, on a characterization of the maximum energy that would be required to operate the second exercise machine at full capacity for a given period of time. This characterization is shown in FIG. 9 at 914, but will likely be done once per exercise machine or type of exercise machine and need not be repeated each time a person exercises on the exercise machine.

As before, the energy exerted by the person, as determined at 912, may be proportional to a machine constant that takes into account inefficiencies and/or mechanical advantages inherent to the second exercise machine.

The characterizations of fitness of the one or more muscles and/or muscle groups determined at 916 may be compared at 918 to one or more corresponding fitness targets for the one or more muscles and/or muscle groups. Feedback may be provided at 920 to the person of how well the person is achieving one or more of the fitness targets. The feedback may be provided while the person is exercising on the second exercise machine and/or at a later time. Alternatively, or in addition, one or more of the fitness targets may be automatically adjusted at 920 based on the comparison.

As the person exercises a third time, a fourth time, and so on, steps similar to 912 and 916 are repeated as needed, with the cumulative effect that the characterization of a particular muscle or muscle group is determined based, at least in part, on the energy exerted by the person on different occasions on one or more exercise machines that impact that particular muscle or muscle group.

A characterization of the fitness of the person as a whole may be determined at 922 based, at least in part, on the characterizations of the fitness of the one or more muscles or muscle groups. The characterization of the fitness of the person as a whole may be based, at least in part, on a characterization of a target fitness level. The target fitness level may be determined from the fitness targets for the various muscles and muscle groups.

The target fitness level may be related to a rehabilitation goal, and this method may be used for one or more of the following purposes:

a) to track the physical function and improvements of people in therapy;
b) to match the physical function of people in rehabilitation to identify readiness to return to work;
c) to evaluate the effectiveness of therapy based on injury type and physical disability, impairment;
d) (by insurance companies) to establish the degree of functional loss resulting from injury in an objective, quantitative manner The target fitness level may be related to suitability to perform a particular task or job. For example, in the case of the job of lifting a box, the total job energy required can be calculated based on a measured weight of the box, the height that the box must be lifted, and any other value. Based on a knowledge of the muscles required to perform the job, a job profile can be generated based on a proportionate distribution of the total job energy. In another example, this method may be used in a sport context to match sports players to predefined ideal profiles based on played position and actual sport, and/or to determine and track individual muscle behaviors prior to the onset of physical injury. In yet another example, this method may be used in a work context for one or more of the following purposes:

a) to match employees to jobs they are expected to perform at work;
b) to objectively identify injury probability based on collected data from various workouts by comparing observed performance to job profiles;
c) to modify, or identify potential modifications to, the ergonomics or physical demands of a job to closer match the physical function of an individual performing that job;
d) to condition, or identify potential training or conditioning programs for, the individual to better match the required physical demands of the job.

The characterization of the fitness of the person as a whole may be based, at least in part, on information related to nutritional intake of the person (which may be stored in the database). The characterization of the fitness of the person as a whole may be based, at least in part, on heart rate information for the person (gathered from a heart rate monitor, for example).

Physical Performance Index (PI)

The characterizations of fitness described hereinabove, the corresponding fitness targets, and the machine maximum energy values may be values on a common numerical scale, referred to herein as "Performance Index" (PI). By using a single scale, PI can be applied to any form of exercise, from aerobics to gym equipment and specialist training. PI is based on the energy a person exerts while exercising. Because different exercises and exercise machines will exercise the body in different ways and use different amounts of energy, using PI as the standard enables comparisons between the different exercises and exercise machines.

As described hereinabove, the information stored in database 131 for the person may include a target workout intensity and feedback provided to the person while exercising may include an indication to increase, sustain or decrease the workout intensity based on a comparison of the calculated workout intensity and the target workout intensity. The calculated workout intensity and the target workout intensity may both be PI values. Indeed, the target workout intensity may be a single target workout intensity for a single activity on a particular exercise machine, or may be applied to different activities on different exercise machines.

The numerical scale may be a linear scale from 0 to 1000, but other scales, including non-linear numerical scales, are also contemplated.

PI values figure prominently in feedback provided via a reports module which is described in more detail hereinbelow.

Software/Hardware Implementation

As will be understood by those of skill in the art, the methods described herein, or portions thereof, can generally be embodied as software residing on a general purpose, or other suitable, computer. The software can be provided on any suitable computer-readable medium. Such computer-readable media can be any available media that can be accessed by a general-purpose or special-purpose computer. By way of example, and not limitation, such computer-readable media may comprise physical computer-readable media such as RAM, ROM, EEPROM, flash memory or other memory technology, CD-ROM, DVD or other optical disk storage, magnetic disk storage or other magnetic storage devices, or any other medium which can be used to carry or store desired program code means in the form of computer-executable instructions or data structures and which can be accessed by a general-purpose or special purpose computer.

When information is transferred or provided over a network or another communications connection (hardwired, wireless, optical or any combination thereof) to a computer system, the computer system properly views the connection as a computer-readable medium. Thus, any such connection is properly termed a computer-readable medium. Combinations of the above should also be included within the scope of computer-readable media. Computer-executable instructions comprise, for example, any instructions and data which cause a general-purpose computer system, special-purpose computer system, or special-purpose processing device to perform a certain function or group of functions. The computer-executable instructions may be, for example, binaries, intermediate format instructions such as assembly language, or even source code.

Figure 10:
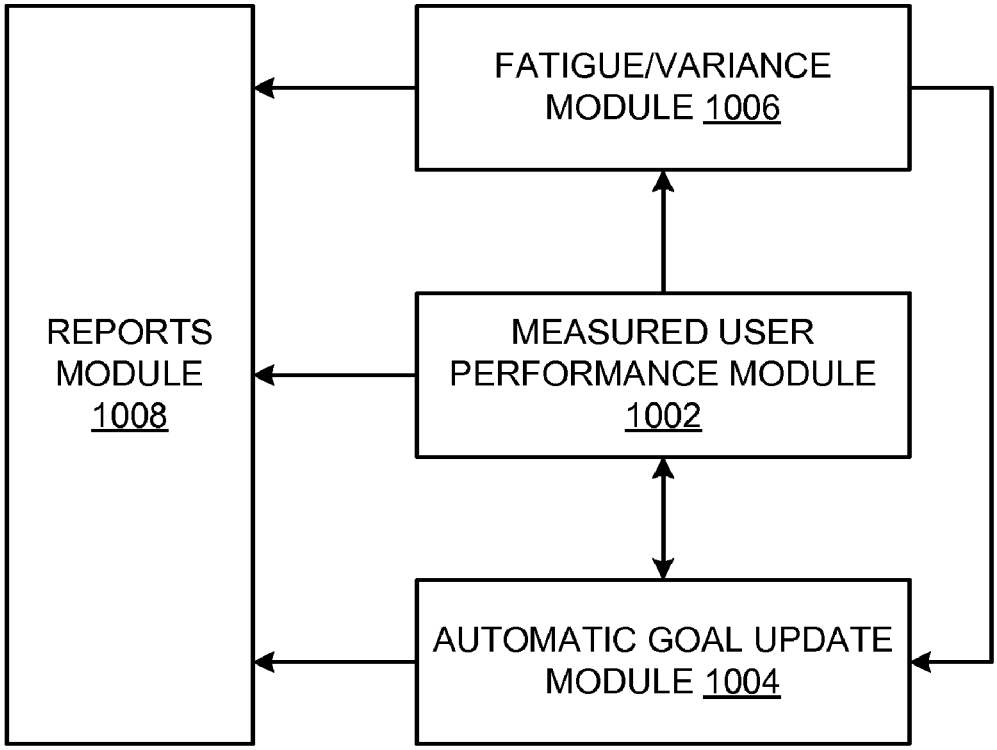
FIG. 10 is a functional diagram of software modules to be implemented in the computer and communication system of FIG. 1.

FIG. 10 is a functional diagram of software modules to be implemented in the computer and communication system of FIG. 1, for example, in computer system 132.

A measured user performance module 1002 is arranged to compare characterizations of the fitness of one or more muscles and/or muscle groups to one or more corresponding fitness targets for the one or more muscles and/or muscle groups.

An automatic goal update module 1004 is coupled to measured user performance module 1002 and is arranged to adjust one or more of the fitness targets based on the comparisons, as described in more detail hereinabove.

A fatigue and variance module 1006 having access to the data generated by measured user performance module 1002 calculates fatigue and consistency of motion. While this module is shown as a single module, the two functions could be implemented separately. The calculations of fatigue and variance, which is a measure of consistency, are described in more detail hereinbelow. Exercise programs may be dynamically modified by automatic goal update module based on calculated fatigue and/or variance.

A reports module 1008 is coupled to modules 1002, 1004, and 1006 and is arranged to provide comprehensive feedback about workouts, fitness and the like. FIGS. 11-15 are illustrations of various reports produced by reports module 1008.

Figure 11:
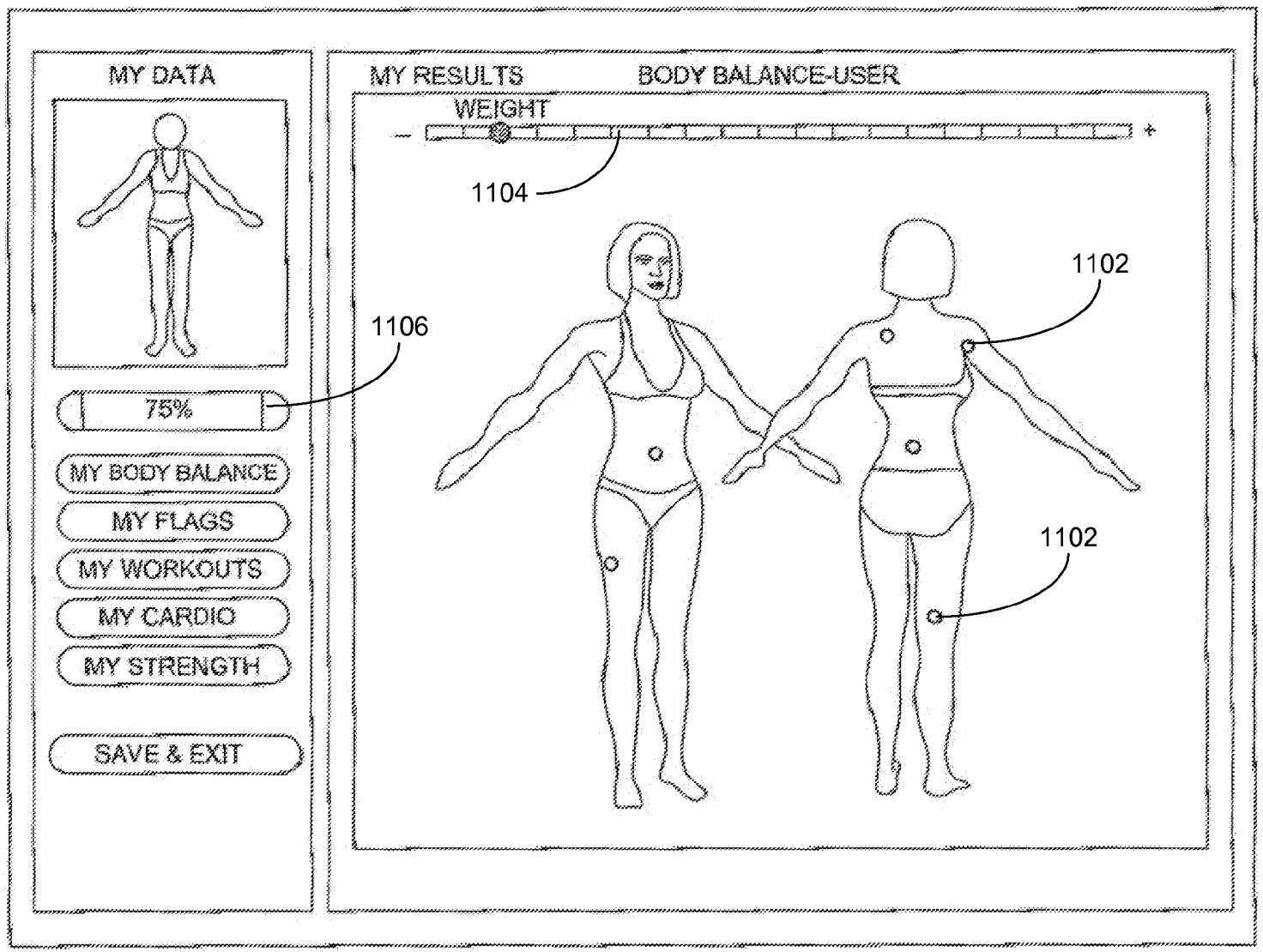
FIG. 11 is an illustration of an individual's body balance report, or overall body summary.

FIG. 11 is an illustration of an individual's body balance report, or overall body summary. The body balance summary looks at the overall energy that was exerted from all the various workouts and matches that to the muscle groups based on the machines that were used. An overall summary of the muscles is provided based on whether the user was in the red, yellow or green zones during the exercise. This reporting result covers all cumulative information for all exercises, and provides an overall indication of how the user has been doing, such as for the last 30 days.

A female/male figure is labelled with muscle group exercise indicators 1102 showing the major muscle groups used during a user's workout. The muscle group indicators indicate relative levels of fitness of the various muscle groups in the person's body. The indicator may indicate a fitness level of the muscle group relative to a target fitness level for the muscle group, or may indicate a fitness level of the muscle group relative to an opposing muscle group, or may indicate a fitness level of the muscle group relative to other muscle groups. For example, each muscle group exercise indicator 1102 may provide an indication of a user-specific muscle-specific workout intensity, such as by displaying different colors. A green color on the muscle group indicates the user have worked that muscle sufficiently to meet the target value, or PI value, and will gain maximum health/fitness benefits from that exercise. A yellow color indicates the muscles were not sufficiently exercised to receive maximum health/fitness benefits. A red color indicates this muscle group was not exercised and will receive no health/fitness benefits from that workout. The female/male figure indicates where deficiencies and muscle imbalances are occurring in workouts. It is easy to focus on the muscle groups that we enjoy working out the most or that give us the best training adaptation but the body balance chart should redirect our attention to real work that needs to be done. Muscular strength imbalances can set you up for injuries or poor performance. The user can use this chart to consistently keep on track.

The system also includes a weight graph or line 1104 that allows the system to modify the body type and shape based on the user's Body Mass Index, body weight, body type and actual measurements of individual body parts. This provides an indication of how the body can change when the user gains and loses weight, and gives a quick illustration of what the user will look like. The body summary is also provided as a percentage of the target human performance as well as with a zone indication 1106, such as a color. The percentage is an efficiency percentage based on the target for that user. The green zone can be defined by percentages of about 66% to about 100% or greater.

Figure 12:
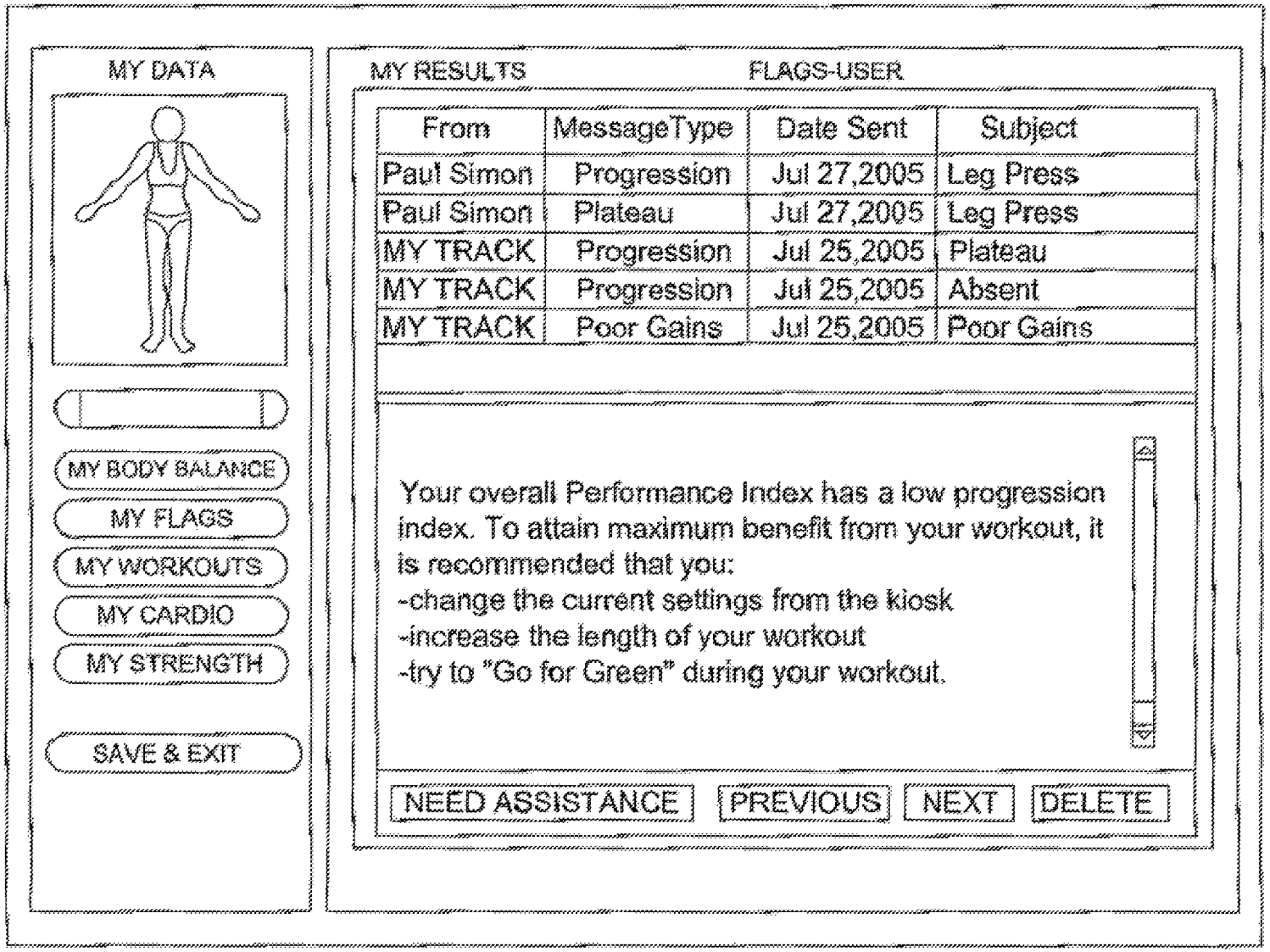
FIG. 12 is an illustration of an individual's exercise messaging report.

FIG. 12 is an illustration of an individual's exercise messaging report. Messages, or flags, are used to provide further information on an area requiring improvement, such as what is being done wrong or what can be improved. The user-specific exercise messaging report can also be referred to as a flags summary, with a flag representing a message or alert. The report screen as shown in FIG. 12 can include a message listing area where basic (or header) data is displayed reporting all messages for that user, and a message display area, where text of a selected message can be viewed, and message handling options are made available. From the flag summary, the user can see all of the indications, or flags, that the system has generated for the user. This can include whether the user is training too hard, too soft, or not fast enough. The system identifies the problem areas and may send a text message to the user identifying the problem areas. The flags are sent to the user's profile at a kiosk, and can alternatively be sent via email, text message or other messaging system so that the user an access the message from home, from the office, etc. The user can acknowledge and delete a message. The user can alternatively indicate that assistance is needed, in which case the message will be forwarded to a personal trainer. In this way, the My Flags section is a communication module between the system of the present invention, the user and the personal trainer.

The table below provides some exemplary flag types, and possible messages or recommendations to accompany the flag, or indication.

| Flag Type | Possible Message/Recommendation |
|---|---|
| Red - if active heart rate is low | Increase rate of muscular contraction<br>Move quickly from one station to the next to avoid HR to drop below training zone<br>Make sure full range of motion is performed on each exercise |
| Red - if active heart rate is high | Slow down rate of muscular contraction<br>Slightly decrease range of motion if already at full range<br>Work at lower % of HR training zone |
| Yellow - Plateau | Vary the order of machines used<br>work at higher % of HR training zone<br>Increase frequency of workouts<br>Check status reports on all monitored variables<br>See staff for variations on workout |
| Yellow - Inconsistent | re-evaluate goals of workout<br>Check status reports on all monitored variables<br>Have staff evaluate workout based on monitored variables |
| General - Sporadic attendance | Workout regularly<br>Try to adhere to a day-on/day-off schedule<br>Workout at least three times per week |
| General - Heart rate high | Slow down rate of muscular contraction<br>Decrease your intensity at each cardio station |
| General - Heart rate low | Increase rate of muscular contraction<br>Move quickly from one station to the next avoiding HR to drop below training zone<br>Increase your intensity at each cardio station |
| General - poor gains (low measured progression index) | Increase the intensity of your workouts<br>Add one more workout throughout the week<br>Increase the length of your workout<br>Try to "Go for Green" during your workout |
| Birthday | "Happy birthday to you, happy birthday to you, Happy workout with MyTrak, and great PI's too!"<br>Best wishes from the staff. |
| Membership expiry | |
| Green | No message needed. Note: Green flag indicates positive progress and a need to increase workout intensity. This condition is met when the entire load is performed in the entire range of motion for all reps |

Figure 13:
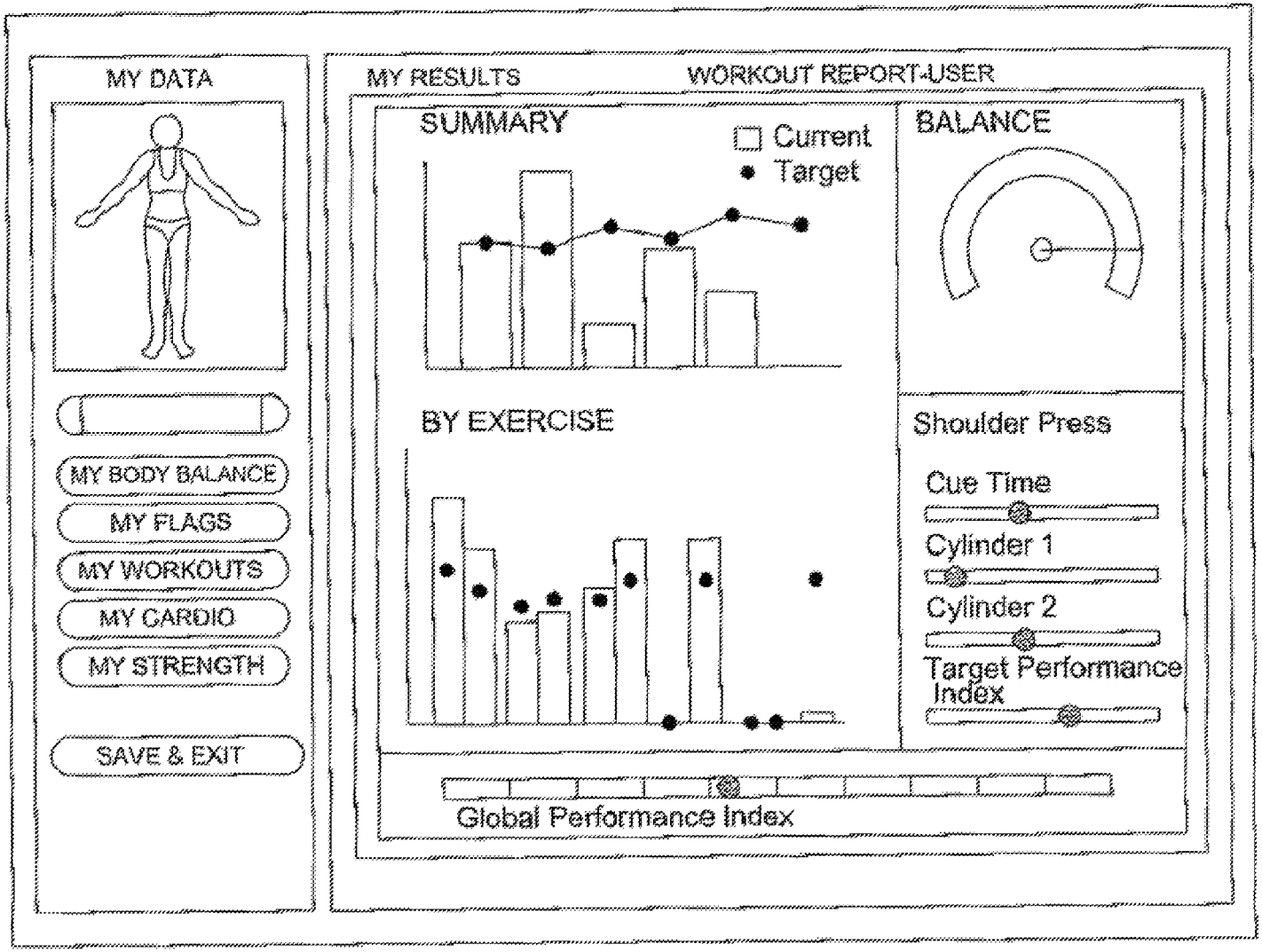
FIG. 13 is an illustration of an individual's workout report.

FIG. 13 is an illustration of an individual's workout report. This report provides a real, full summary of the workout by date. The user can observe results, trends, and compare these with the goals that were set for each day.

The user is assigned a scale and the intention is to progressively increase the scale over time. The system sets the scale to be a numeric value, measures the person's workout and provides a number for the target and the workout result. If the system determines that the user was not able to achieve the goal that was set, the goal is automatically and dynamically decreased for the next workout, to make it less challenging for the user. The system will continually reduce the target if the user repeatedly cannot achieve the target that is set. The system monitors the user's performance and increases or decreases the target based on the results. The user can also manually change the target performance index goal. An overall scale is provided based on the average of the user's performance and the average of the PIs overall.

By selecting a particular day's workout, the user can access information regarding specific workouts on specific machines. The machine-specific information shows the measured performance and the target performance for each of the machines. The system includes the ability to change the weight and number of reps in the profile, providing the user with full control over those features and parameters.

Figure 14:
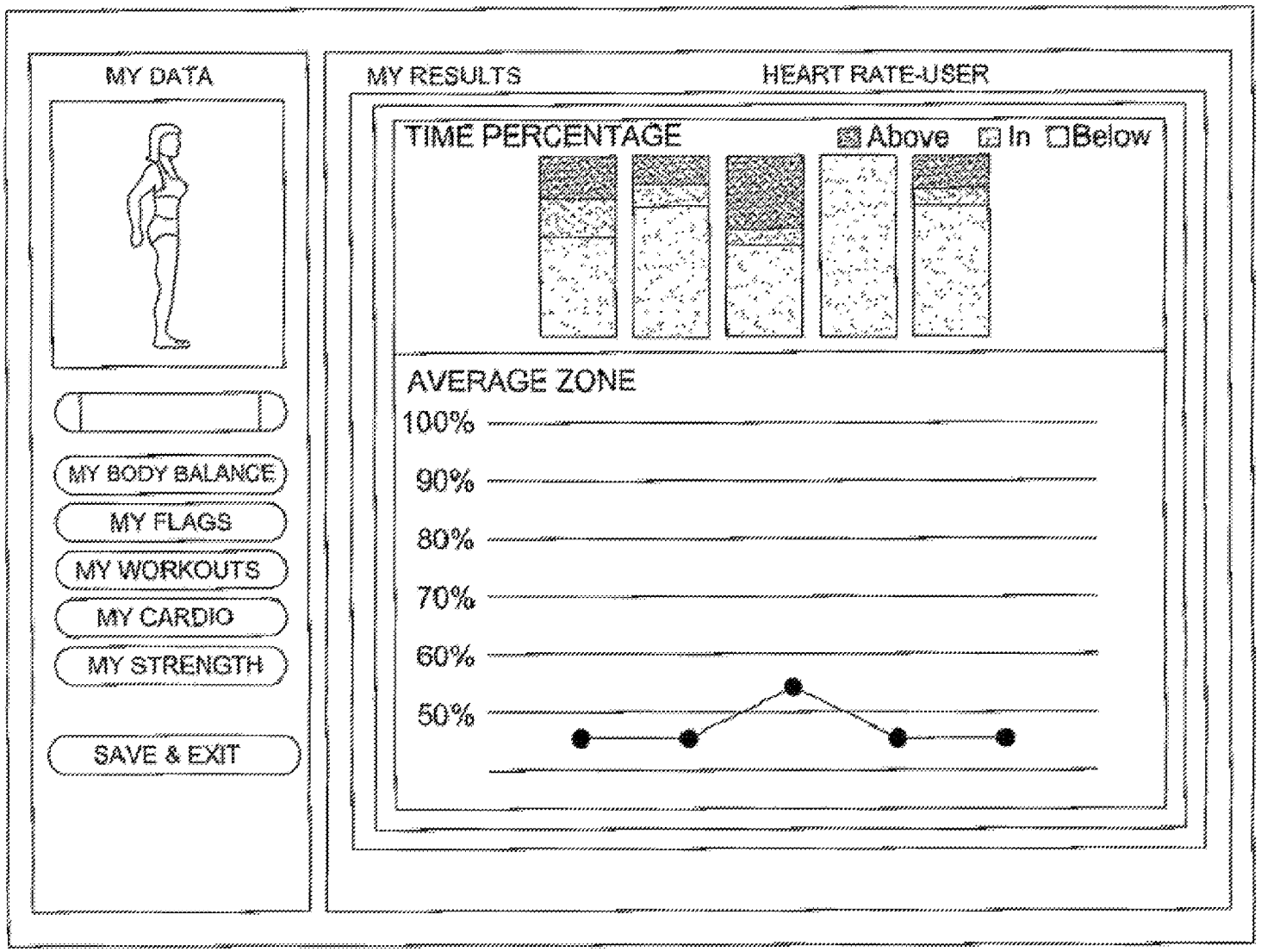
FIG. 14 is an illustration of an individual's cardiovascular performance report.

FIG. 14 is an illustration of an individual's cardiovascular performance report, based on information that was collected by a heart rate monitor. The heart rate monitor measures the heart rate and the system tracks the amount of time that the heart rate was below the desired target zone, within the desired target zone, and above the desired target zone. For each day, there should be red, yellow and green portions in the graph, such as a cylinder, and ideally a larger proportion of the time is spent within the desired target zone. The system calculates a target heart rate zone with a lower limit and upper limit based on measured heart rate and age. The system also provides indications of the desired heart rate level for different types of exercise.

Figure 15:
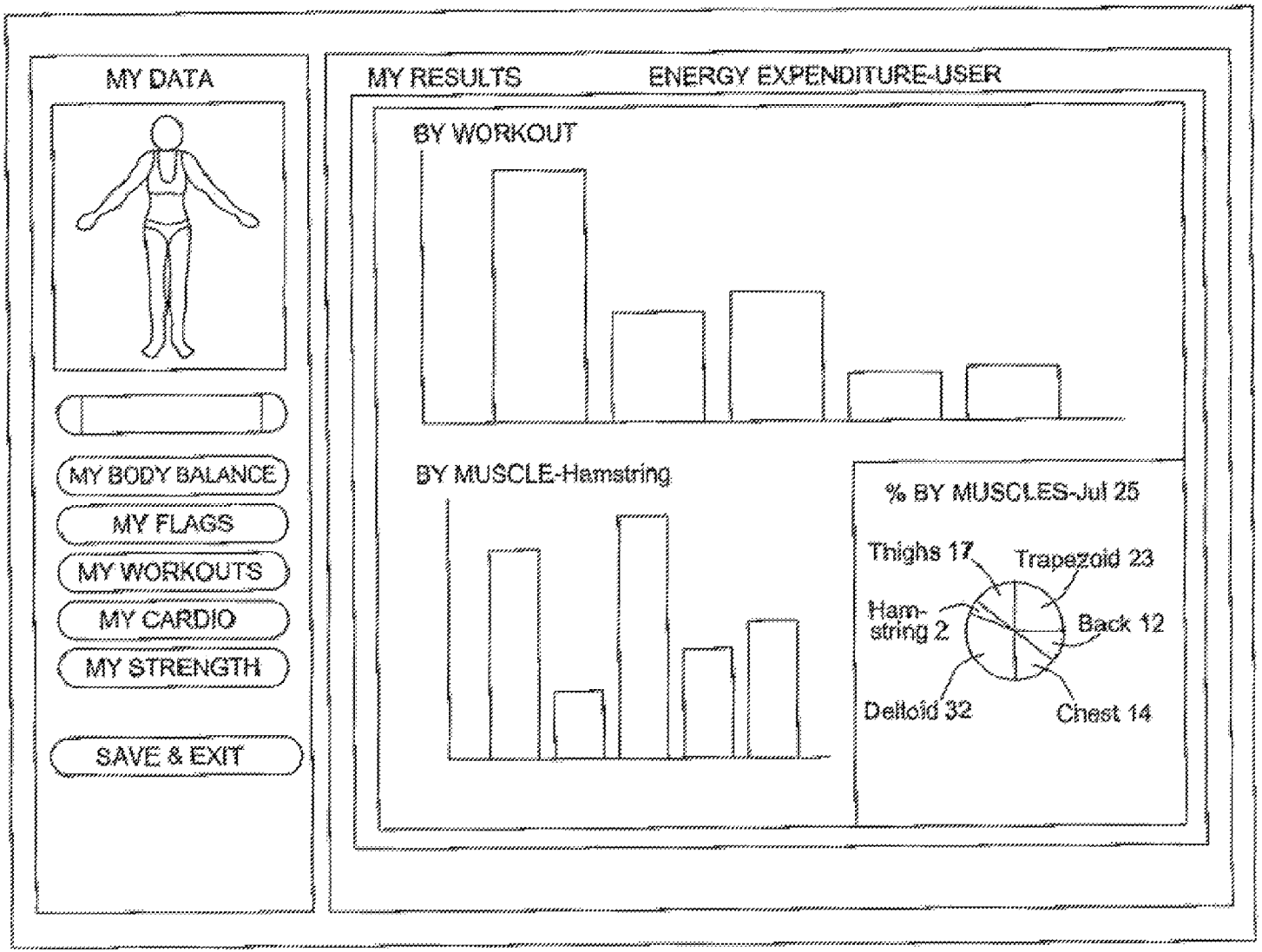
FIG. 15 is an illustration of an individual's strength report.

FIG. 15 is an illustration of an individual's strength report, showing an indication of the total energy expended by the user. This report provides information relating to each muscle group, rather than relating the results to each machine. The system can consolidate the exercise from each of the machines into different muscle groups based on stored information relating to the muscle groups being exercised by each machine. The user can observe the overall muscle performance for different muscle groups, such as triceps, biceps, thighs, hamstring, back, etc. The module also can provide a visual indication, such as a pie chart, that shows each of the muscle groups and the proportion of exertion. By clicking on a particular muscle group, the user can observe by date the energy expended on that particular muscle group. This provides a useful overall, global snapshot of performance.

Fatigue and Variance/Consistency

When exercising, a person typically experiences fatigue. In a normal healthy individual training at the full intensity, a strength loss rate of about 10% is expected. A coefficient of variance is a measure of consistency. If energy is increasing or decreasing but consistency is lacking, the person is not trying their best. The fatigue and variance module looks at the relationship between consistency and fatigue, with ideal values being a fatigue of about 10% and a consistency variation of about 0%.

Figure 16:
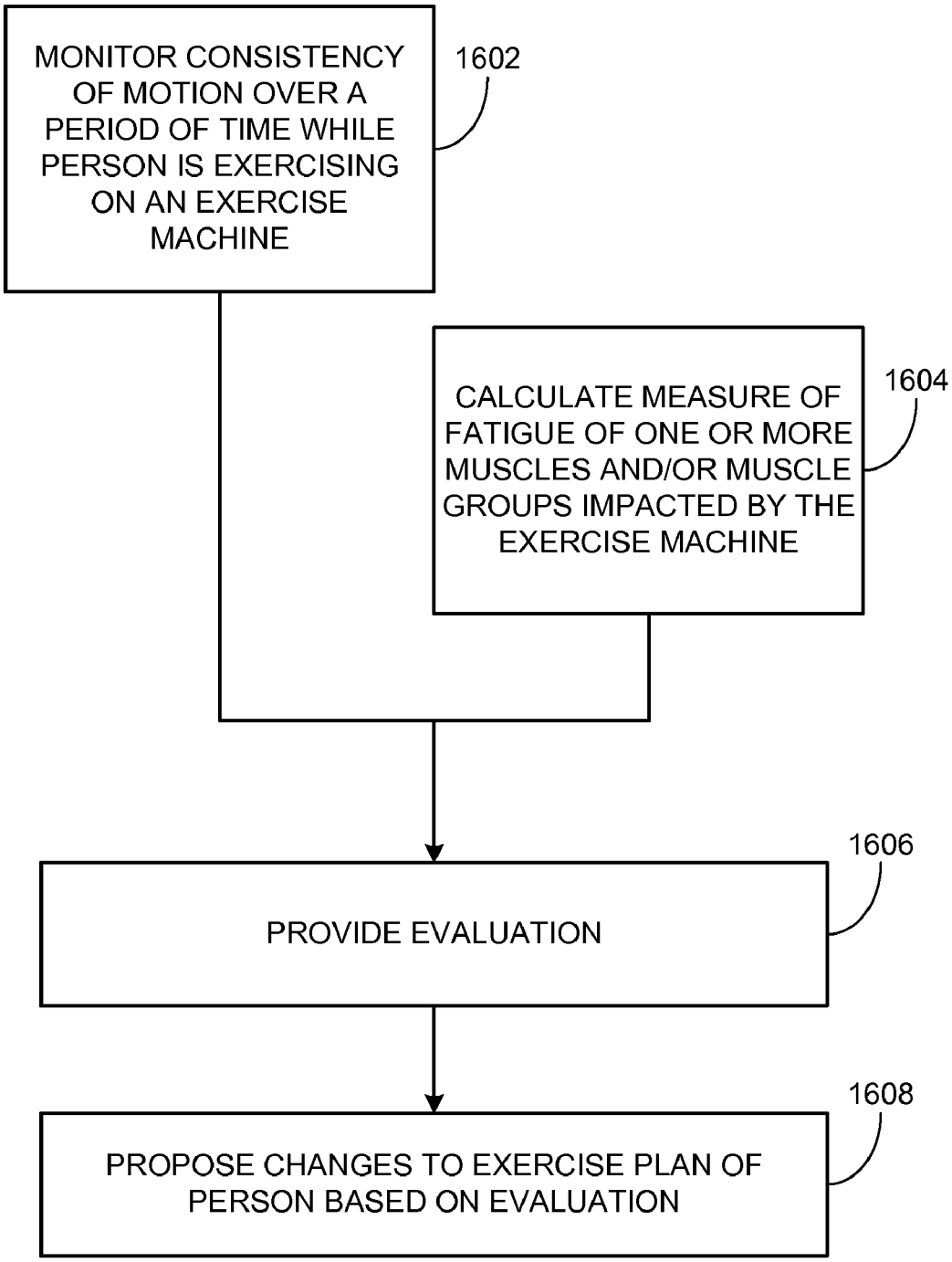
FIG. 16 is a flowchart of an exemplary method for providing exercise feedback.

FIG. 16 is a flowchart of an exemplary method for providing exercise feedback. Consistency of motion over a period of time while a person is exercising on an exercise machine that impacts one or more muscles and/or muscle groups of the musculoskeletal system is monitored at 1602. Monitoring the consistency of motion may comprise collecting data relating to each individual stroke of the motion. Each stroke in an exercise (or individual exercise movement) can be summarized, with its distance, position, range of motion, energy, fatigue, heart rate, and performance. Monitoring the consistency of motion may comprise considering an actual range of motion relative to an individual range of motion for the person on the exercise machine. For example, the person may be capable of a wider range of motion than the person is actually achieving in this exercise session.

A measure of fatigue of the one or more muscles and/or muscle groups impacted by the exercise machine is calculated at 1604, either prior to, after or substantially concurrently with the monitoring of consistency of motion.

An evaluation of the exercise session is provided to the person at 1606 based, at least in part, on the measure of fatigue and the monitored consistency. Changes to an exercise plan of the person may be proposed at 1608 based on the evaluation.

For example, the evaluation may be that the person is not making a sufficient effort, or that the person is making a sufficient effort.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A hydraulic exercise machine system comprising:

one or more hydraulic cylinders;

a mechanism coupled to at least one of the hydraulic cylinders, where displacement of the mechanism by a person exercising on the hydraulic exercise machine displaces pistons of the hydraulic cylinders relative to the cylinders;

a sensor assembly to measure displacement of a piston relative to its cylinder over time during a workout session;

electronic means for analyzing data from the sensor assembly during the workout session, the analysis including calculating user performance data based on mechanical variables of an activity of the person when exercising on the hydraulic exercise machine together with mechanical properties of the hydraulic exercise machine and comparing the user performance data with information stored in a database for the person; a reflector physically coupled to the piston; a radiation source physically coupled to the piston's cylinder; and a radiation detector physically coupled to the piston's cylinder to detect reflected radiation resulting from the reflector reflecting radiation emitted by the radiation source; and a display to provide visual feedback to the person during the workout session based, at least in part, on the analyzed data.

2. The hydraulic exercise machine system of claim 1, further comprising:

electronic means for processing one or more sets of mechanical properties corresponding to the one or more hydraulic cylinders, wherein the visual feedback to the person is based, at least in part, on the one or more sets of processed mechanical properties.

3. The hydraulic exercise machine system of claim 2, wherein the visual feedback includes an indication to increase, sustain or decrease workout intensity during the workout session.

4. The hydraulic exercise machine system of claim 3, wherein the display comprises a light bar, which displays a first color if the indication is to increase the workout intensity, displays a second color if the indication is to sustain the workout intensity, and displays a third color if the indication is to decrease the workout intensity.

5. A hydraulic exercise machine system, comprising:

at least one hydraulic cylinder;

a mechanism coupled to the at least one hydraulic cylinder such that displacement of the mechanism by a person exercising on the hydraulic exercise machine system displaces a piston of the hydraulic cylinder relative to the cylinder;

a sensor assembly to measure displacement of a piston relative to its cylinder over time during a workout session;

means for analyzing data from the sensor assembly during the workout session, the analysis including calculating user performance data based on mechanical variables of an activity of the person when exercising on the hydraulic exercise machine together with mechanical properties of the hydraulic exercise machine and comparing the user performance data with information stored in a database for the person; a reflector physically coupled to the piston; a radiation source physically coupled to the piston's cylinder; and a radiation detector physically coupled to the piston's cylinder to detect reflected radiation resulting from the reflector reflecting radiation emitted by the radiation source;

a display to provide feedback to the person during the workout session based, at least in part, on the analyzed data, the feedback including an indication to increase, sustain, or decrease workout intensity during the workout session.

6. The hydraulic exercise machine system of claim 5, wherein the display comprises a light bar, which displays a first color if the indication is to increase the workout intensity, displays a second color if the indication is to sustain the workout intensity, and displays a third color if the indication is to decrease the workout intensity.

7. A hydraulic exercise machine system, comprising:

at least one hydraulic cylinder;

a mechanism coupled to the at least one hydraulic cylinder such that displacement of the mechanism by a person exercising on the hydraulic exercise machine system displaces a piston of the hydraulic cylinder relative to the cylinder;

a sensor assembly to measure displacement of a piston relative to its cylinder over time during a workout session, the sensor assembly having a reflector coupled to the piston and having a radiation source and a radiation detector coupled to the cylinder to detect reflected radiation resulting from the reflector reflecting radiation emitted by the radiation source;

means for analyzing data from the sensor assembly during the workout session, the analysis including calculating a workout intensity based on mechanical variables of an activity of the person when exercising on the hydraulic exercise machine and comparing the workout intensity with a predetermined target workout intensity;

a display to provide feedback to the person during the workout session based, at least in part, on the data, the feedback including an indication to increase, sustain, or decrease the workout intensity during the workout session.

* * * * *